US008680840B2

(12) United States Patent
Iacob et al.

(10) Patent No.: US 8,680,840 B2
(45) Date of Patent: Mar. 25, 2014

(54) CIRCUITS AND METHODS OF PRODUCING A REFERENCE CURRENT OR VOLTAGE

(75) Inventors: Radu H. Iacob, Santa Clara, CA (US); Marian Badila, San Jose, CA (US)

(73) Assignee: Semiconductor Components Industries, LLC, Phoenix, AZ (US)

( * ) Notice: Subject to any disclaimer, the term of this patent is extended or adjusted under 35 U.S.C. 154(b) by 184 days.

(21) Appl. No.: 12/703,842

(22) Filed: Feb. 11, 2010

(65) Prior Publication Data

US 2011/0193544 A1 Aug. 11, 2011

(51) Int. Cl.
*G05F 3/18* (2006.01)

(52) U.S. Cl.
USPC ..... 323/313; 323/311; 323/907

(58) Field of Classification Search
USPC ..... 323/281, 311, 313, 314, 315, 907
See application file for complete search history.

(56) References Cited

U.S. PATENT DOCUMENTS

| | | | | |
|---|---|---|---|---|
| 4,096,430 | A | 6/1978 | Waldron | |
| 4,127,783 | A | 11/1978 | Alaspa | |
| 4,158,804 | A | 6/1979 | Butler et al. | |
| 4,498,040 | A | 2/1985 | Tatsushi et al. | |
| 4,559,694 | A | 12/1985 | Yoh et al. | |
| 4,723,108 | A | 2/1988 | Murphey et al. | |
| 4,792,749 | A * | 12/1988 | Kitagawa et al. | 323/314 |
| 4,812,681 | A | 3/1989 | Pumphrey | |
| 4,814,686 | A | 3/1989 | Watanabe | |
| 5,117,177 | A | 5/1992 | Eaton, Jr. | |
| 5,124,632 | A * | 6/1992 | Greaves | 323/316 |
| 5,315,230 | A | 5/1994 | Cordoba et al. | |
| 5,376,935 | A | 12/1994 | Seligson | |
| 5,394,359 | A | 2/1995 | Kowalski | |
| 5,493,141 | A | 2/1996 | Ricco et al. | |
| 5,563,760 | A | 10/1996 | Lowis | |
| 5,629,612 | A * | 5/1997 | Schaffer | 323/313 |
| 5,739,682 | A | 4/1998 | Kay | |
| 5,745,000 | A | 4/1998 | Boerstler et al. | |
| 5,873,053 | A * | 2/1999 | Pricer et al. | 702/130 |
| 5,901,085 | A | 5/1999 | Kramer et al. | |
| 5,910,914 | A | 6/1999 | Wang | |
| 5,952,946 | A | 9/1999 | Kramer et al. | |

(Continued)

FOREIGN PATENT DOCUMENTS

JP 2000172353 6/2000

OTHER PUBLICATIONS

IEEE STD 100-2000, 10.1109/IEEESTD.2000.322234, 2000, pp. 246-247.*

(Continued)

*Primary Examiner* — Adolf Berhane
*Assistant Examiner* — Gustavo Rosario Benitez
(74) *Attorney, Agent, or Firm* — Paul J. Polansky

(57) ABSTRACT

A reference circuit includes a first transistor having a first current electrode, a control electrode, and a second current electrode coupled to a power supply terminal. The reference circuit further includes a resistive element including a first terminal coupled to the control electrode of the first transistor and a second terminal coupled to the first current electrode. Additionally, the reference circuit includes a second transistor including a first current electrode coupled to the second terminal of the resistive element, a control electrode coupled to the second terminal, and a second current electrode coupled to the power supply terminal. The second transistor is configured to produce an output signal related to a voltage at the control electrode of the first transistor.

20 Claims, 10 Drawing Sheets

(56) References Cited

U.S. PATENT DOCUMENTS

| | | | | |
|---|---|---|---|---|
| 5,990,816 | A | 11/1999 | Kramer et al. | |
| 6,014,044 | A | 1/2000 | Kramer et al. | |
| 6,091,286 | A | 7/2000 | Blauschild | |
| 6,157,245 | A * | 12/2000 | Rincon-Mora | 327/539 |
| 6,215,352 | B1 * | 4/2001 | Sudo | 327/530 |
| 6,222,470 | B1 | 4/2001 | Schuelke | |
| 6,297,689 | B1 | 10/2001 | Merrill | |
| 6,414,536 | B1 | 7/2002 | Chao | |
| 6,441,680 | B1 | 8/2002 | Leung et al. | |
| 6,448,844 | B1 * | 9/2002 | Cho | 327/538 |
| 6,667,653 | B2 | 12/2003 | Kronmueller et al. | |
| 6,737,909 | B2 * | 5/2004 | Jaussi et al. | 327/541 |
| 6,744,277 | B1 | 6/2004 | Chang et al. | |
| 6,768,371 | B1 | 7/2004 | Layton et al. | |
| 6,771,054 | B2 * | 8/2004 | Duval | 323/313 |
| 6,798,278 | B2 | 9/2004 | Ueda | |
| 6,882,582 | B2 | 4/2005 | Sicard et al. | |
| 6,885,958 | B2 | 4/2005 | Yaklin | |
| 6,914,831 | B2 | 7/2005 | Di Iorio | |
| 6,919,753 | B2 | 7/2005 | Wang et al. | |
| 6,930,538 | B2 | 8/2005 | Chatal | |
| 6,970,037 | B2 | 11/2005 | Sakhuja et al. | |
| 7,034,603 | B2 | 4/2006 | Brady et al. | |
| 7,038,530 | B2 | 5/2006 | Chou | |
| 7,042,205 | B2 * | 5/2006 | Tseng et al. | 323/315 |
| 7,109,785 | B2 | 9/2006 | Derksen | |
| 7,149,123 | B2 | 12/2006 | Georgescu et al. | |
| 7,245,536 | B1 | 7/2007 | Poenaru et al. | |
| 7,288,985 | B2 | 10/2007 | Serrano et al. | |
| 7,372,316 | B2 | 5/2008 | Chatterjee et al. | |
| 7,872,463 | B2 | 1/2011 | Jongsma | |
| 8,013,588 | B2 | 9/2011 | Imura | |
| 8,188,785 | B2 | 5/2012 | Iacob | |
| 2001/0014035 | A1 | 8/2001 | Briner | |
| 2002/0036488 | A1 | 3/2002 | Ueda | |
| 2002/0060600 | A1 | 5/2002 | Ueda | |
| 2003/0058694 | A1 | 3/2003 | Marotta et al. | |
| 2003/0146785 | A1 | 8/2003 | Ueda | |
| 2005/0046469 | A1 | 3/2005 | Geissler | |
| 2005/0052223 | A1 | 3/2005 | Sakhuja et al. | |
| 2007/0109876 | A1 | 5/2007 | Umezawa | |
| 2007/0241809 | A1 | 10/2007 | Kothandaraman et al. | |
| 2008/0048900 | A1 * | 2/2008 | Voicu et al. | 341/144 |
| 2008/0150502 | A1 * | 6/2008 | Migliavacca | 323/281 |
| 2008/0239825 | A1 | 10/2008 | Yamada | |
| 2010/0156386 | A1 * | 6/2010 | Imura | 323/313 |
| 2011/0193544 | A1 | 8/2011 | Iacob | |
| 2011/0248688 | A1 | 10/2011 | Iacob | |
| 2011/0254521 | A1 | 10/2011 | Iacob | |

OTHER PUBLICATIONS

Blauschild, R.A, Tucci, P.A., Muller, R.S., Meyer, R.G., A New NMOS Temperature-Stable Voltage Reference, IEEE Journal of Solid-State Circuits, vol. SC-13, No. 6, Dec. 1978.

Hirobumi Watanabe, Member, IEEE, Shunsuke Ando, Hideyuki Aota, Masanori Dainin, Yong-Jin Chun, and Kenji Taniguchi, Fellow, IEEE, CMOS Voltage Reference Based on Gate Work Function Differences in Poly-Si Controlled by Conductivity Type and Impurity Concentration, IEEE Journal of Solid-State Circuits, vol. 38, No. 6, Jun. 2003.

Actions on the Merits for co-pending U.S. Appl. No. 12/700,290, filed Feb. 4, 2010 and U.S. Appl. No. 12/700,329, filed Feb. 4, 2010.

* cited by examiner

CIRCUITS AND METHODS OF PRODUCING A REFERENCE CURRENT OR VOLTAGE

CROSS REFERENCE TO RELATED, COPENDING APPLICATIONS

Related subject matter is found in a copending patent application entitled "Current-Mode Programmable Reference Circuits and Methods Therefor," application Ser. No. 12/700,290, invented by Radu H. Iacob and Alexandra-Oana Petroianu, filed Feb. 4, 2010 and assigned to the assignee hereof, and a copending patent application entitled "Mixed-Mode Circuits and Methods of Producing a Reference Current and a Reference Voltage," application Ser. No. 12/700,329, invented by Radu H. Iacob and Marian Badila, filed Feb. 4, 2010 and assigned to the assignee hereof.

FIELD

The present disclosure is generally related to circuits and methods of producing a reference current or voltage, and more particularly to circuits including drain-coupled MOS devices to produce the reference current.

BACKGROUND

Current and voltage references are building blocks used in virtually every mixed-signal system. There are a variety of methods for implementing voltage or current references, ranging from the comparison of bias voltages across simple semiconductor devices to the quantum tunneling of electric charge on floating-gate devices.

One method for providing voltage and current references uses the silicon energy bandgap. In bandgap reference circuits, the reference current or voltage is derived from two p-n junctions operated at different current densities, each having a different forward bias voltage drop. The voltage difference between forward voltage drops is applied across a resistor to generate a proportional to absolute temperature (PTAT) current, which is further converted into a (PTAT) voltage. The PTAT voltage can then be added to a complementary to absolute temperature (CTAT) voltage derived from another p-n junction. The voltage can then be applied to a reference resistor to produce a thermally compensated reference current.

However, recent technological advances use low-voltage complementary metal oxide semiconductor (CMOS) circuits designed to reduce power consumption and to extend battery life of portable devices, operating at lower supply voltages. Thus, voltage head-room has become increasingly limited, making it difficult to use conventional bandgap reference circuits in such low-power applications.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of MOS reference circuits are described below that provide an output reference current or voltage, which is maintained across a wide range of power supply and temperature conditions. In particular, the MOS reference circuits are designed to operate within a range of power supply voltages between approximately 1.7V and 5.6V. In some instances, the circuits may be operated at lower voltages, such as at voltage levels as low as 1.2 to 1.5 volts, when using floating-gate transistors that are programmed to have low threshold voltages. The nominal operating voltage may be approximately 2.0 volts. Biased by the power supply voltage, embodiments of the MOS reference circuits provide reliable current line regulation, while offering flexibility for implementing various thermal compensation techniques.

Embodiments of the MOS reference circuits apply a difference of gate-to-source voltages of two MOS transistors across a resistive element (such as a resistor) to produce a reference current. In an example, the MOS transistors are connected in a common-source configuration with the drains coupled together to provide the same drain-to-source ($V_{DS}$) condition for both devices. One of the MOS transistors is configured as a diode (i.e., the gate is connected to one of the current electrodes in a diode configuration) acting as a clamp, and the second MOS transistor operates as a gain device and has its gate connected to one end of the reference resistor. The other end of the resistor is connected to a common drain node of the MOS transistors. A feedback loop preserves the level of current flowing through the reference resistor. In some embodiments, additional thermal compensation stages are employed for preserving a relatively constant current or voltage at low power supply voltages and across a wide range of temperature conditions.

In the following discussion, the term "resistor" is used to refer a resistive element, such as a passive resistor, a programmable device, or other circuit element that provides a desired electrical resistance. While some of the illustrated embodiments depict passive resistors, it should be understood that passive resistors are shown for the ease of discussion, but that such passive resistors may be replaced with programmable floating-gate transistors, which can be programmed to produce a desired resistance, or with other resistive elements to provide the desired resistance value.

Figure 1:
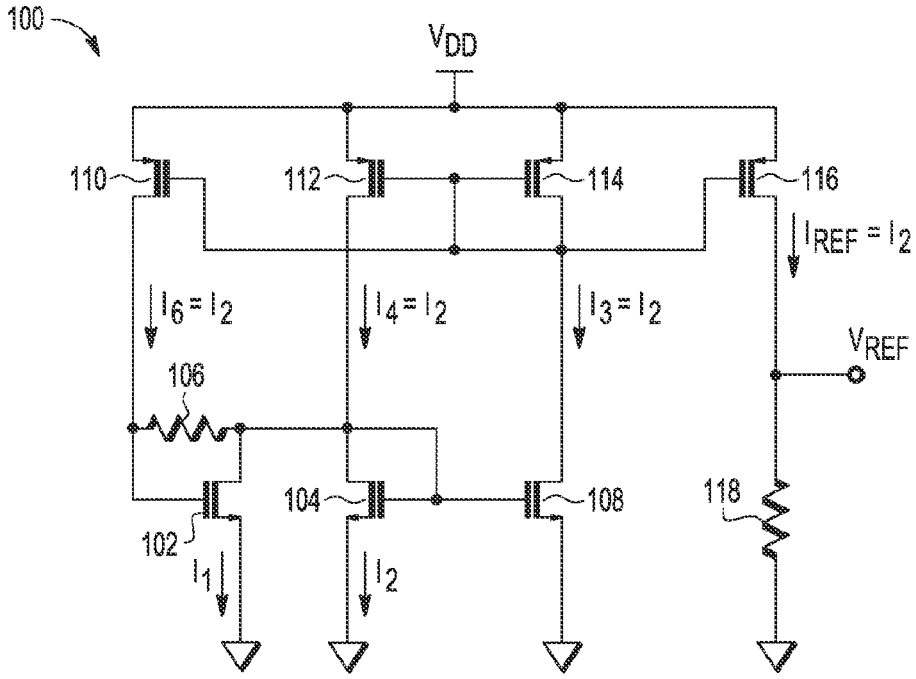
FIG. 1 is a schematic diagram of an embodiment of a reference circuit including drain-coupled metal oxide semiconductor (MOS) transistors to generate a reference current.

FIG. 1 is a schematic diagram of an embodiment of a reference circuit 100 including drain-coupled metal oxide semiconductor (MOS) transistors 102 and 104 to generate a reference current. Circuit 100 includes n-channel MOS (NMOS) transistors 102, 104, and 108, resistors 106 and 118, and p-channel MOS (PMOS) transistors 110, 112, 114, and 116.

PMOS transistor 110 and NMOS transistor 102 cooperate to form a first current path that carries the current ($I_6$). PMOS transistor 110 includes a source connected to a first power supply terminal labeled "$V_{DD}$," a gate, and a drain connected to a first terminal of resistor 106. Resistor 106 also includes a second terminal connected to a drain of NMOS transistor 102. NMOS transistor 102 includes the drain, a gate connected to the drain of PMOS transistor 110 and to the first terminal of resistor 106, and a source connected to a second power supply terminal. In the illustrated embodiment, the second power supply terminal is ground. In an alternative embodiment, the second power supply terminal may be another power supply voltage that is negative relative to a voltage on $V_{DD}$.

PMOS transistor 112 and NMOS transistor 104 cooperate to form a second current path configured to carry a second current ($I_4$). PMOS transistor 112 includes a source connected to $V_{DD}$, a gate connected to the gate of PMOS transistor 110, and a drain connected to the drain of NMOS transistor 102. NMOS transistor 104 includes a drain connected to the drain of NMOS transistor 102, a gate connected to its drain in a diode configuration, and a source connected to ground.

PMOS transistor 114 and NMOS transistor 108 cooperate to form a third current path configured to carry third current ($I_3$). PMOS transistor 114 includes a source connected to $V_{DD}$, a gate connected to the gates of PMOS transistors 110 and 112, and a drain connected to the gates of PMOS transistors 110, 112, and 114. NMOS transistor 108 includes a drain connected to the drain of PMOS transistor 114, a gate connected to the gate of NMOS transistor 104, and a source connected to ground.

PMOS transistor 116 and resistor 118 cooperate to form an output current path to carry a reference current ($I_{REF}$) related to the third current ($I_3$). The PMOS transistor 116 includes a source connected to $V_{DD}$, a gate connected to the drain of PMOS transistor 114, and a drain connected to a first terminal of resistor 118 and providing an output voltage ($V_{REF}$). Resistor 118 includes a second terminal connected to ground.

Circuit 100 applies the difference between the gate-to-source voltages of NMOS transistors 102 and 104 across resistor 106 to set the reference current ($I_{REF}$). At equilibrium, the transistors 102 and 104 have identical drain currents (i.e., $I_1=I_2$) and identical drain-to-source voltages ($V_{DS102}=V_{DS104}$), and are both in saturation. The bias current for transistor 104 is provided by a feedback loop including NMOS transistor 108 and PMOS transistors 114 and 112, and the bias current for transistor 102 is provided by a feedback loop including NMOS transistor 108 and PMOS transistors 114 and 110. The bias currents flow into the common drain and flow through the drain-to-source current paths of transistors 102 and 104. If the transistor pairs 104 and 108, 112 and 114, and 110 and 114 are substantially the same size, the currents ($I_1$, $I_2$, $I_6$, $I_4$, $I_3$, and $I_{REF}$) are substantially equal.

In an example, the voltage on $V_{DD}$ has a nominal value of 2.0 volts with respect to ground. A current mirror formed by transistors 112 and 114 mirrors the second current ($I_2$) through the first current path. When the supply voltage is applied to $V_{DD}$, the voltage at the gates of PMOS transistors 110, 112, 114, and 116 are sufficiently negatively biased relative to the supply voltage to allow current flow through their respective source-to-drain current paths. If transistors 110 and 114 have approximately equal sizes, then the first current ($I_6$) is also approximately equal to the second current ($I_2$). The different gate-to-source voltages of the transistors 102 and 104 establish the second current ($I_2$).

The second current ($I_2$) also sets the voltage on the gate of transistor 108 forming a current mirror with transistors 104 and 108. An additional current mirror is formed by transistors 114 and 116 to mirror the second current ($I_2$) through transistors 114 and 116 to generate the reference current ($I_{REF}$), which is sourced on resistor 118 to generate the reference voltage ($V_{REF}$). The reference current ($I_{REF}$) is proportional to the third current ($I_3$). If transistors 114 and 116 have the substantially the same size, the reference current ($I_{REF}$) is substantially equal to the third current ($I_3$). However, in some implementations, transistor 116 can be sized differently to provide a reference current ($I_{REF}$) that is a multiple of the third current ($I_3$).

Circuit 100 is an example of a CMOS circuit that can operate with low voltage headroom. In particular, the circuit can operate properly when $V_{DD}$ is only approximately equal to a MOS gate-to-source and a MOS drain-to source voltages above ground.

However, transistor 112 has limited output resistance. Accordingly, it may be desirable to isolate the coupled drains of transistors 102 and 104 from the drain of transistor 112 to provide improved line regulation. A modified version of circuit 100 is depicted in FIG. 2, which uses resistor 106 to isolate the coupled drains of both transistors 102 and 104 from the drain of transistor 112.

Figure 2:
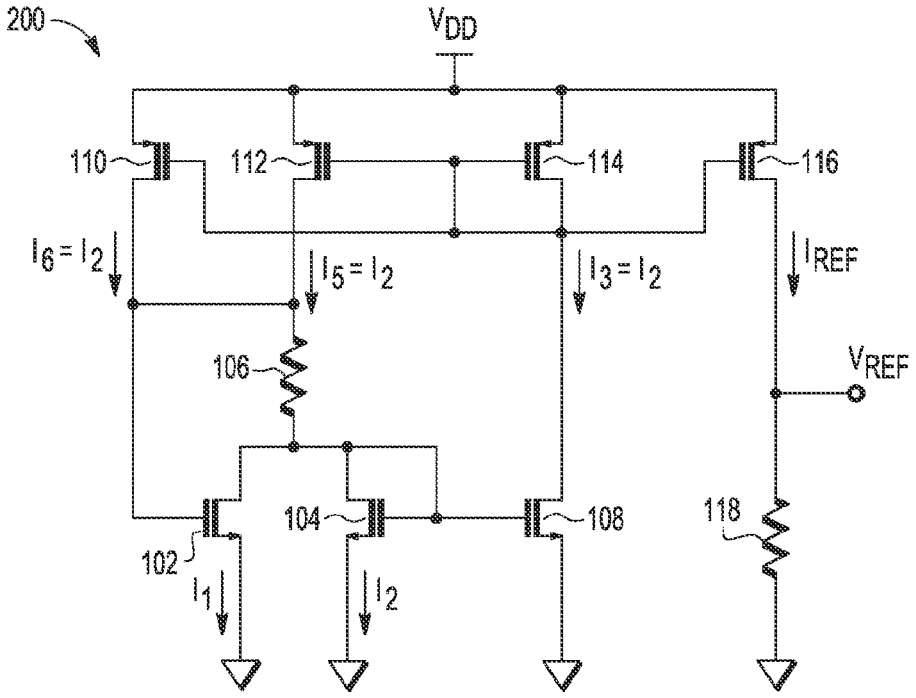
FIG. 2 is a schematic diagram of a second embodiment of a reference circuit including drain-coupled MOS transistors to generate a reference current.

FIG. 2 is a schematic diagram of a second embodiment of a reference circuit 200 including drain-coupled MOS transistors 102 and 104 to generate a reference current. Circuit 200 includes the same components as described above with respect to circuit 100 in FIG. 1. However, in circuit 200, resistor 106 is connected differently. In circuit 100, the drain of PMOS transistor 112 is connected to the drains of NMOS transistors 102 and 104. In contrast, in circuit 200, the drain of PMOS transistor 112 is connected to a first terminal of resistor 106. The first terminal of resistor 106 is also connected to the drain of PMOS transistor 110 and to the gate of NMOS transistor 102. Resistor 106 further includes a second terminal connected to the drains of NMOS transistors 102 and 104 and to the gates of NMOS transistors 104 and 108.

In the illustrated example, if PMOS transistors 110, 112, 114, and 116 have approximately equal sizes, then the currents through each of the transistors are approximately equal ($I_6=I_5=I_3=I_2=I_1=I_{REF}$). Since current does not flow into the gate of transistor 102, current ($I_6$) and current ($I_5$) flow through resistor 106. Thus, PMOS transistors 110 and 112 source twice the current (i.e., $I_6+I_5=2I_2$) through the resistor 106, providing the bias currents for transistors 102 and 104 through a single current branch. At the same time, this configuration isolates the drains of transistors 102 and 104 from the limited output resistance of PMOS transistor 112, resulting in a very good line regulation of the second current ($I_2$) through transistor 104. Similar drain currents and the common drain-to-source voltage bias for transistors 102 and 104 allow for mutual cancellation of the variation of certain device parameters with respect to temperature, making it easier to implement various thermal compensation techniques.

If transistor 102 and resistor 106 were not present in circuit 100, under ideal conditions, at equilibrium the feedback loop that includes transistors 104, 108, 114, and 112 would preserve a wide range of substantially equal currents, relatively independent of the power supply. However, when the gain of the positive feedback system (i.e., transistors 104, 108, 114, and 112) is greater than unity, any environmental disturbance will cause the current through the loop to increase up to a value determined by the output resistance of the transistors 104, 108, 114, and 112, and by power supply headroom limitations.

Therefore, a regulating mechanism is provided by the negative feedback loop (transistors 102, 108, 114, and 110), which has three inverting stages (transistors 102, 108, and 110). For the embodiment described by circuit 200, the current sourced by transistor 112 flows entirely through resistor 106, biasing the gate of NMOS transistor 102 to such value that equilibrium is maintained. In order to achieve stability, the negative feedback is stronger than the positive feedback.

In an alternative embodiment, transistor 110 is omitted, and transistor 112 is sized to source twice the current as transistors 114 and 116. In this instance, the mirroring of the currents ($I_2$ and $I_3$) through transistors 104 and 108 can be further improved by including a pair of intrinsic transistors 302 and 304, as shown in FIG. 3.

Figure 3:
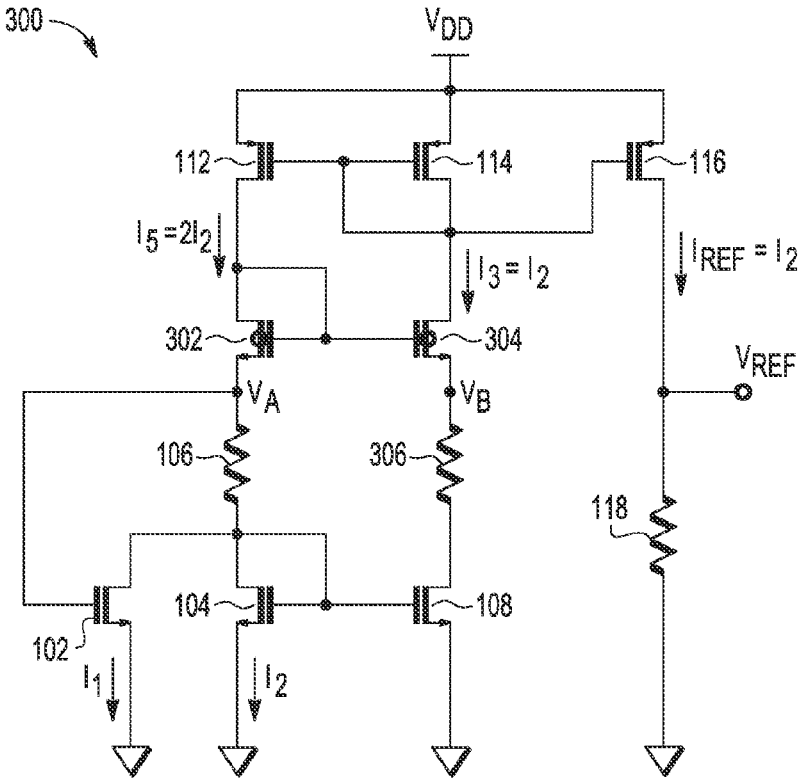
FIG. 3 is a schematic diagram of a third embodiment of a reference circuit including drain-coupled MOS transistors to generate a reference current.

FIG. 3 is a schematic diagram of a third embodiment of a reference circuit 300 including drain-coupled MOS transistors 102 and 104 to generate a reference current. In circuit 300, PMOS transistor 110 is omitted as compared to FIGS. 1 and 2. Otherwise PMOS transistors 112, 114, and 116, resistors 106 and 118, and NMOS transistors 102, 104, and 108 are configured as described with respect to FIG. 2. However, in this embodiment, PMOS transistor 112 is sized relative to each of the transistors 114 and 116 to have a current ratio of two-to-one (2:1). Further, transistors 302 and 304 and resistor 306 are added.

The mirroring of the currents ($I_2$ and $I_3$) through transistors 104 and 108 is improved by cascoding the current branches with the transistors 302 and 304. In the illustrated embodiment, transistors 302 and 304 are intrinsic transistors with a threshold voltage of approximately zero volts. Zero or low threshold transistors are used in order to preserve the low voltage operation capability of circuit 300. Intrinsic transistor 302 includes a drain connected to the drain of PMOS transistor 112, a gate connected to the drain in a diode configuration, and a source connected to the first terminal of resistor 106 and to the gate of transistor 102. Intrinsic transistor 304 includes a drain connected to the drain of PMOS transistor 114, a gate connected to the gate of transistor 302, and a source connected to a first terminal of resistor 306, which includes a second terminal connected to the drain of transistor 108. Resistor 306 is added on the drain of transistor 304 to improve matching of the bias conditions for transistors 104 and 108.

Transistor 302 is diode-connected and has a low threshold voltage (such as approximately zero volts), such that a voltage at the source of transistor 302 (i.e., at node $V_A$) is substantially the same as a voltage on its gate and drain. Transistor 304 is a source follower, such that a voltage at the gate of transistor 304 is substantially equal to a voltage at the source of transistor 304 (i.e., at node $V_B$).

In FIG. 3, the second current ($I_2$) and the corresponding reference current ($I_{REF}$) are related to the resistance of resistor 106, which effects the bias of transistor 302. In particular, the current ($I_5$) is proportional to the difference of the gate-to-source voltages of transistors 102 and 104 divided by the resistance of resistor 106, as shown in the following equation:

$$I_5 = \frac{V_{GS102} - V_{GS104}}{R_{106}} \tag{1}$$

where $I_{REF}=I_2=0.5I_5$. The reference voltage ($V_{REF}$) is related to the resistance of resistor 118, such that $V_{REF}=I_{REF}*R_{118}$. In a particular example, when the resistors 106 and 118 are of the same type, the thermal variation of the resistors 106 and 118 are mutually cancelled such that the behavior of $V_{REF}$ is unaffected by temperature.

Further, circuit 300 can be implemented using transistors 102 and 104 of the same type but with different multiplication factors of their width/length (W/L) ratio. The relationship between the reference current ($I_{REF}$) or the reference voltage ($V_{REF}$) and the device sizes can be determined by circuit simulation or analytically, using well-known circuit analysis techniques, both of which are well known to those of ordinary skill in the art. For example, transistors 102 and 104 can have a ratio of one-to-m (1:m), where the variable (m) represents a multiplication factor. In this example, transistors 102 and 104 are operated in saturation, at similar values of drain currents as the drain-to-source voltages vary. Since transistors 102 and 104 are of the same type, in order to achieve the condition where the gate-to-source voltage of transistor 102 is greater than the gate-to-source voltage of transistor 104, the sizes of the transistors 102 and 104 are chosen such that the size of transistor 104 is proportional to the size of transistor 102 according to the following equation:

$$\frac{W_{104}}{L_{104}} = m\frac{W_{102}}{L_{102}} \tag{2}$$

As is known in the art, the relative sizes of the transistors can be adjusted to produce a current mirror with a ratio of one-to-two (1:2), yielding a current ($I_3$) that is twice the current ($I_2$). The current ($I_3$) can be sourced into the first current path, including transistors 102 and 104 and resistor 106, causing a voltage drop across resistor 106 equal to the gate-to-source voltage difference between transistors 102 and 104 as follows:

$$V_{GS102}=2I_2R_{106}+V_{GS104} \tag{3}$$

Since transistor 104 sinks the drain current ($I_2$), the remaining current through the drain of transistor 102 is as follows:

$$I_1=2I_2-I_2 \tag{4}$$

such that the first current ($I_1$) is approximately equal to half of the reference current ($I_{REF}$).

Considering transistors 102 and 104 operating in strong inversion and in the saturation region, the gate-to-source voltage of transistors 102 and 104 can be determined according to equations 5 and 6 below.

$$V_{GS102} = V_{Th102} + \sqrt{\frac{2I_1}{\mu_n C_{ox}} \frac{L_{102}}{W_{102}} \frac{1}{1+\lambda V_{DS102}}} \quad (5)$$

$$V_{GS104} = V_{Th104} + \sqrt{\frac{2I_2}{\mu_n C_{ox}} \frac{L_{104}}{W_{104}} \frac{1}{1+\lambda V_{DS104}}} \quad (6)$$

Substituting equations 5 and 6, Equation (3) can be rewritten as follows:

$$V_{Th102} + \sqrt{\frac{2I_{102}}{\mu_n C_{ox}} \frac{L_{102}}{W_{102}} \frac{1}{1+\lambda V_{DS102}}} = V_{Th104} + \sqrt{\frac{2I_{104}}{\mu_n C_{ox}} \frac{L_{104}}{W_{104}} \frac{1}{1+\lambda V_{DS104}}} + 2I_2 R_{106} \quad (7)$$

If the threshold voltages of transistors 102 and 104 are substantially equal, the factor ($\lambda V_{DS}$) is substantially equal for the two transistors. Further, the equality of currents through transistors 102 and 104 yields the following equation:

$$I_2 = \frac{1}{2R_{106}} \sqrt{\frac{2I_1}{\mu_n C_{ox}} \frac{1}{1+\lambda V_{DS}} \left( \frac{1}{\sqrt{\frac{W_{102}}{L_{102}}}} - \frac{1}{\sqrt{\frac{W_{104}}{L_{104}}}} \right)} \quad (8)$$

and $$I_2 = \frac{2}{\mu_n C_{ox} R_{106}^2} \left( \frac{1}{\sqrt{\frac{W_{102}}{L_{102}}}} - \frac{1}{\sqrt{\frac{W_{104}}{L_{104}}}} \right) \quad (9)$$

When $\lambda=0$, the equation for the reference current can be simplified as follows:

$$I_{REF} = 2I_2 = \frac{1}{R_{106}^2} \frac{1}{\mu_n C_{ox} \sqrt{\frac{W_{102}}{L_{102}}}} \left(1 - \frac{1}{\sqrt{m}}\right)^2 \quad (10)$$

As shown in Equation 10, the reference current ($I_{REF}$) has a first order variation with temperature due to the temperature coefficient of the resistor 106 ($R_{106}=R_{106}(T)$) and due to the variation of the mobility ($\mu_n$) with temperature as follows:

$$\mu_n(T) = \mu_n(T_0)\left(\frac{T}{T_0}\right)^{-\beta_{\mu_n}} \quad (11)$$

The variation of the mobility with temperature can also be expressed in the formula of the drain current by substituting the drain current ($I_D$) for the mobility ($\mu_n$) within equation 11. Further, the variation of the reference current due to temperature can be determined according to the following equation:

$$\frac{dI_{REF}}{dT} = I_{REF}(T)\beta_{\mu n}\left(\frac{T}{T_0}\right)^{-1} \quad (12)$$

Figure 12:
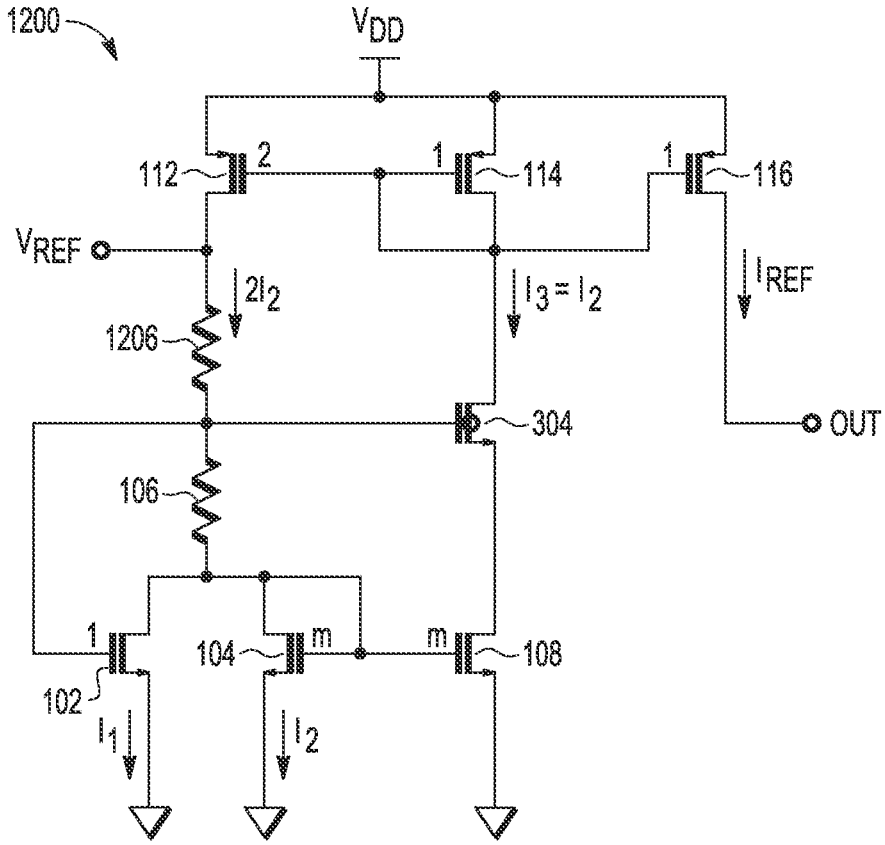
FIG. 12 is a schematic diagram of an embodiment of a drain-coupled current reference circuit for use in a low-voltage, low-power environment.

The advantages of the drain-coupled current reference are best emphasized in a low-voltage low-power environment, when the devices are operated in subthreshold, such as for the circuit illustrated in FIG. 12.

FIG. 12 is a schematic diagram of an embodiment of a drain-coupled current reference circuit 1200 for use in a low-voltage, low-power environment. As compared to circuit 300 depicted in FIG. 3, transistor 302 is omitted. In this alternative embodiment, circuit 1200 includes an additional resistor 1206 on the drain of transistor 112 and in series with resistor 106. Resistor 1206 has a first terminal connected to the drain electrode of transistor 112 and a second terminal connected to the first terminal of resistor 106. The gate electrode of transistor 304 is connected to the second terminal of resistor 1206. At equilibrium, after power-up, the reference current ($I_{REF}$) is established by gate-to-source voltage differences between transistors 102 and 104 applied across resistor 106. The drain current of transistor 102 is proportional to the size of transistor 102 and can be determined according to the following equation:

$$I_{D102} = \frac{W_{102}}{L_{102}} I_{D0} \exp^{\frac{q(V_{GS102}-V_{Th})}{nkT}} \quad (13)$$

In equation 13, (W) represents the width of the transistor, (L) represents the length of the transistor, ($I_{D0}$) represents a process dependent parameter, (q) represents the electric charge of the electron, (k) is the Boltzmann's constant, (T) is the junction temperature in degrees Kelvin, and ($V_{Th}$) is the threshold voltage of the transistor. Similarly, the drain current ($I_{D104}$) of transistor 104 can be determined according to the following equation:

$$I_{D104} = m\frac{W_{102}}{L_{102}} I_{D0} \exp^{\frac{q(V_{GS104}-V_{Th})}{nkT}} \quad (14)$$

Solving for the difference in the gate-to-source voltages between transistors 102 and 104, such difference can be expressed by to the following equation:

$$\text{Difference} = V_{GS102} - V_{GS104} = \frac{nkT}{q} \ln m \quad (15)$$

The reference current ($I_{REF}$), which is proportional to absolute temperature, is proportional to the current through resistor 106 according to the following equation:

$$I_{REF} = \frac{1}{R_{106}} \frac{nkT}{q} \ln m \quad (16)$$

The reference voltage ($V_{REF}$) is generated at the first terminal of resistor 1206 and can be determined from the following equation:

$$V_{REF} \approx \frac{R_{116}}{R_{106}} \frac{nkT}{q} \ln m + V_{Th} \quad (17)$$

By appropriately sizing the resistors 106 and 206 and by sizing the widths and lengths of transistors 102 and 104 to achieve a desired multiplier (m), it is possible to achieve first order thermal compensation. Thus, a more precise expression for the reference voltage ($V_{REF}$) can be derived from the logarithmic variation in sub-threshold of gate-to-source voltage ($V_{GS}$) with the drain current ($I_D$) according to the following equation:

$$V_{GS102} = V_{Th102} + \frac{nkT}{q}\ln\frac{I_{REF}}{2\frac{W_{102}}{L_{102}}I_{D0}} \tag{18}$$

Further, the reference voltage ($V_{REF}$) can be calculated with greater precision using substitution according to the following equation:

$$V_{REF} = \frac{nkT}{q}\left(\frac{R_{206}}{R_{106}}\ln m + \ln\frac{\frac{nkT}{q}\ln m}{2R1\frac{W_{102}}{L_{102}}I_{D0}}\right) + V_{TH} \tag{19}$$

By selecting the transistors width, length and multiplier factor, and the resistance values for thermal compensation, circuit 300 can achieve a temperature coefficient of less than 25 ppm/° C.

In another alternative embodiment of the circuit in FIG. 3, transistor 302 can be omitted. In this alternative example, transistor 304 preserves comparable gate-to-source voltage values for transistors 102 and 104, assuming a small voltage drop across resistor 106. Appropriate sizing of transistor 304 can be used to provide good cascode performance. In another embodiment, transistor 302 can be omitted and transistor 304 can be replaced with an enhancement MOS transistor having a size selected to conduct a current proportional to the current ($I_5$) in a different ratio.

In yet another embodiment, transistors 112 and 116 can each be sized to have a ratio of two-to-one (2:1) relative to transistor 114. Further, transistors 104 and 108 can each be sized to have a ratio of m-to-one (m:1) relative to transistor 102, where the variable m is a multiplier. Further, an additional diode-connected transistor can be included on the output current path. The additional transistor includes a drain connected to the second terminal of resistor 118, a gate connected to the drain, and a source connected to ground. In this instance, the gate-to-source voltage of the additional transistor (not shown) can be expressed according to the following equation:

$$V_{GS} = V_{TH} + \frac{nkT}{q}\ln\frac{I_{REF}}{2p\frac{W_{102}}{L_{102}}I_{D0}} \tag{20}$$

Using relative sizing to adjust the currents allows for lower voltage headroom, making it possible to operate the circuit at lower supply voltage levels. The thermal compensation is provided by compensating the temperature variation of the proportional to absolute temperature (PTAT) current with the variation of the complementary to absolute temperature (CTAT) current.

The drain-coupled current reference circuits depicted in FIGS. 1-3 and 12 have an advantage of requiring lower headroom, thus accepting lower supply voltage levels. Moreover, the common-source architecture with MOS devices operated in sub-threshold can be used to implement a low-voltage, low-power thermally compensated voltage reference. Such thermal compensation is based on compensating variation with temperature of a PTAT current with the variation of a complementary to absolute temperature (CTAT) current. The PTAT current can be generated by an IPTAT reference circuit, such as the one represented in FIG. 4.

Figure 4:
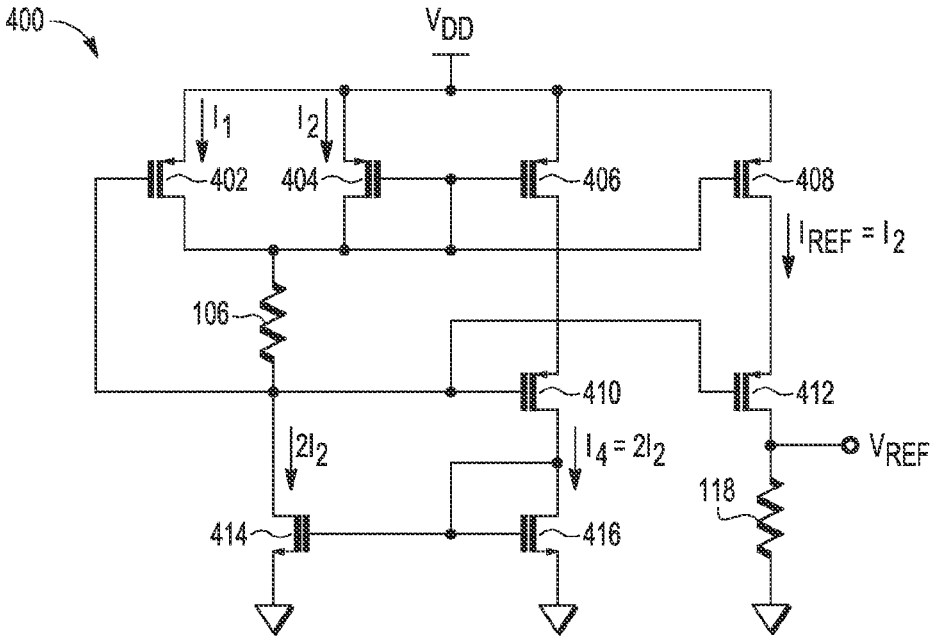
FIG. 4 is schematic diagram of a fourth embodiment of a reference circuit including drain-coupled MOS transistors to generate a reference current.

FIG. 4 is schematic diagram of a fourth embodiment of a reference circuit 400 including drain-coupled MOS transistors 402 and 404 to generate a reference current. Circuit 400 includes PMOS transistors 402, 404, 406, 408, 410 and 412, resistors 106 and 118, and NMOS transistors 414 and 416. PMOS transistor 402 includes a source connected to the first power supply terminal ($V_{DD}$), a drain connected to the first terminal of resistor 106, and a gate connected to the second terminal of resistor 106. PMOS transistor 404 includes a source connected to $V_{DD}$, a gate and a drain connected to the first terminal of resistor 106. PMOS transistor 406 includes a source connected to $V_{DD}$, a gate connected to the gate of PMOS transistor 404, and a drain. PMOS transistor 408 includes a source connected to $V_{DD}$, a gate connected to the first terminal of resistor 106, and a drain.

Resistor 106 includes the first terminal and includes a second terminal connected to the gate of PMOS transistor 402. NMOS transistor 414 includes a drain connected to the second terminal of resistor 106, a gate, and a source connected to ground.

PMOS transistor 410 includes a source connected to the drain of PMOS transistor 406, a gate connected to the second terminal of resistor 106, and a drain connected to the gate and drain of NMOS transistor 416. NMOS transistor 416 includes a gate connected to the gate of NMOS transistor 414, and a source connected to ground.

PMOS transistor 412 includes a source connected to the drain of PMOS transistor 408, a gate connected to the second terminal of resistor 106, and a drain connected to a first terminal of resistor 118, which includes a second terminal connected to ground.

In the illustrated embodiment, when power is applied to circuit 400, the gates of transistors 402, 404, 406 and 408 are sufficiently negatively biased relative to $V_{DD}$ for current to flow through transistors 402, 404, 406, and 408. Currents ($I_1$ and $I_2$) through transistors 402 and 404 flow through resistor 106 and to the drain of transistor 414. If transistors 406 and 404 have approximately a ratio of two-to-one (2:1), then the currents ($I_1$ and $I_2$) are approximately equal so that the current through resistor 106 is approximately equal to twice the second current (i.e., $2I_2$).

Each of the transistors 406 and 410 are sized to establish a two-to-one (2:1) ratio between transistor 406 and each of the transistors 402, 404, and 408. Transistor 406 mirrors the second current ($I_2$) proportionally to produce current ($I_4$), which is two times the second current. Transistor 410 operates to reduce the voltage variation at the drain of transistor 406. Transistor 416 is diode connected, and the current ($I_4$) flows through transistor 416 to ground, while transistor 414 mirrors the current ($I_4$).

Transistor 408 is configured to mirror the current flowing through transistor 404 having a ratio of one-to-one with transistors 404, mirroring the second current ($I_2$) to generate the reference current ($I_{REF}$), which is a PTAT current. Transistor 412 is configured to reduce the voltage variation at the drain of transistor 408. The reference current ($I_{REF}$) can then be sourced on resistor 118 to generate the reference voltage ($V_{REF}$). In an alternative embodiment, transistors 408 and 412 can be sized such that the reference current ($I_{REF}$) is different from but still proportional to the second current ($I_2$).

Figure 5:
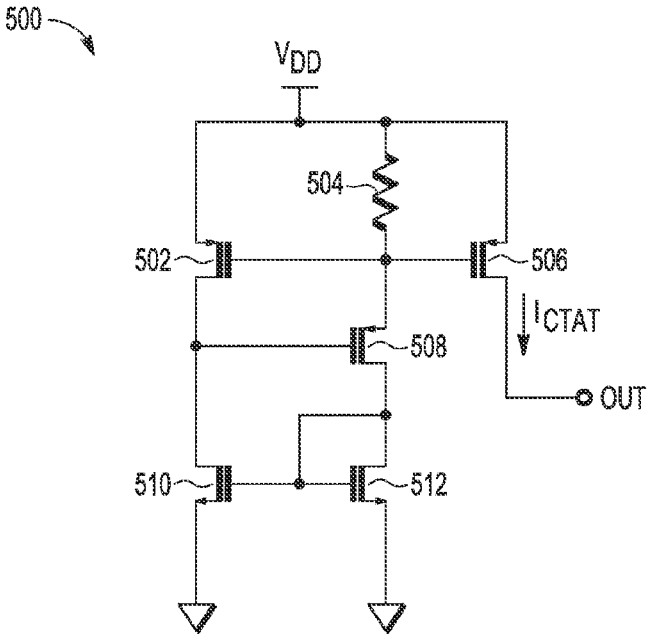
FIG. 5 is a schematic diagram of an embodiment of a complementary to absolute temperature (CTAT) reference circuit to generate a CTAT current ($I_{CTAT}$).

As previously discussed, the thermal compensation is based on compensating variation with temperature of a PTAT current with the variation of a CTAT current. FIG. 5 depicts an example of a CTAT current reference circuit.

FIG. 5 is a schematic diagram of an embodiment of a complementary to absolute temperature (CTAT) reference circuit 500 to generate a CTAT current. Circuit 500 includes PMOS transistors 502, 506, and 508, resistor 504, and NMOS transistors 510 and 512. Resistor 504 includes a first terminal connected to the first power supply terminal ($V_{DD}$) and includes a second terminal. PMOS transistor 502 includes a source connected to the first power supply terminal ($V_{DD}$), a gate connected to the second terminal of resistor 504, and a drain.

PMOS transistor 506 includes a source connected to $V_{DD}$, a gate connected to the second terminal of resistor 504, and a drain connected to an output node (OUT). PMOS transistor 508 includes a source connected to the second terminal of resistor 504, a gate connected to the drain of PMOS transistor 502, and a drain.

NMOS transistor 510 includes a drain connected to the gate of PMOS transistor 508, a gate, and a source connected to ground. NMOS transistor 512 is a diode-connected transistor including a drain connected to the drain of PMOS transistor 508, a gate connected to the drain and to the gate of NMOS transistor 510, and a source connected to ground. In the illustrated embodiment, the sources of transistors 510 and 512 are connected to ground, but the second power supply terminal may be replaced by another power supply, which is negative relative to $V_{DD}$.

In the illustrated embodiment, when power is applied to the first power supply terminal, PMOS transistors 502, 506, and 508 are sufficiently negatively biased relative to $V_{DD}$ for current to flow through their respective source-to-drain current paths. Since transistor 512 is diode-connected, the voltage at the drain of transistor 512 is sufficient to turn transistor 512 on, allowing current flow through its drain-to-source current path. Similarly, the voltage at the drain of transistor 512 turns on transistor 510, allowing current flow through its drain-to-source current path.

Transistors 508 and 502, and resistor 504 cooperate to form a feedback loop such to control current flow through transistor 502 and into the drain of transistor 510. Current flow through transistor 502 is mirrored by transistor 506 to provide the CTAT current.

In operation, the voltage at the gate of transistor 508 is a gate-to-source voltage lower than the voltage at the gate of 502 and 506. Thus, circuit 500 can operate reliably above a minimum power supply voltage according to the equation below:

$$V_{DDmin}=V_{DS510}+V_{SG508}+V_{GS502} \tag{21}$$

Figure 6:
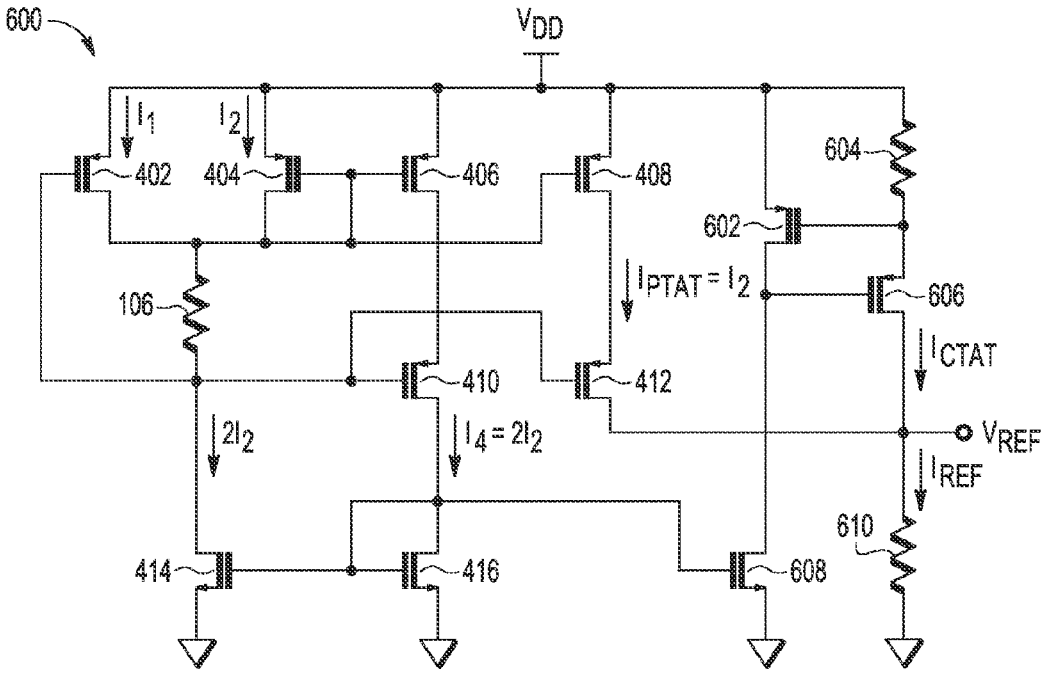
FIG. 6 is a schematic diagram of a second embodiment of a reference circuit including drain-coupled PMOS transistors to generate a proportional to absolute temperature (PTAT) current ($I_{PTAT}$) and a complementary to absolute temperature (CTAT) current ($I_{CTAT}$), that are summed up on the output node in order to generate a thermally compensated reference current ($I_{REF}$).

Circuit 500 can be used to generate a CTAT current, which can be added to a PTAT current to produce a thermally compensated reference current ($I_{REF}$) as depicted in FIG. 6.

FIG. 6 is a schematic diagram of a second embodiment of a reference circuit 600 including drain-coupled PMOS transistors 402 and 404 to generate a proportional to absolute temperature (PTAT) current ($I_{PTAT}$) and a CTAT current ($I_{CTAT}$) that add up in the output node to generate a reference current ($I_{REF}$). Circuit 600 includes the circuit 400 depicted in FIG. 4 (with resistor 118 omitted) combined with a portion of the CTAT reference circuit 500 depicted in FIG. 5. However, since the CTAT reference circuit is configured differently in circuit 600, the elements of the CTAT reference circuit are renumbered. The CTAT reference circuit portion includes PMOS transistors 602 and 606, resistors 604 and 610, and NMOS transistor 608.

Resistor 604 includes a first terminal connected to the first power supply terminal ($V_{DD}$) and a second terminal. PMOS transistor 602 includes a source connected to $V_{DD}$, a gate connected to the second terminal of resistor 602, and a drain. NMOS transistor 608 includes a drain connected to the drain of PMOS transistor 602, a gate connected to the drain of transistor 416, and a source connected to ground.

PMOS transistor 606 includes a source connected to the gate of PMOS transistor 602, a gate connected to the drain of PMOS transistor 602, and a drain connected to the drain of PMOS transistor 412. Resistor 610 includes a first terminal connected to the drain of PMOS transistor and includes a second terminal connected to ground.

In the illustrated embodiment, when power is applied to $V_{DD}$, transistors 402, 404, 406, 408, 410, 414, and 416 operate as described with respect to FIG. 4 to produce the PTAT current ($I_{PTAT}$). The PTAT current flows through the source-to-drain current path of transistor 412 and is sourced on resistor 610 to generate a PTAT portion of the reference voltage ($V_{REF}$). Further, the gates of PMOS transistor 602 and 606 are sufficiently negatively biased relative to $V_{DD}$ to allow current flow through the source-to-drain current paths. The voltage at the drain of transistor 416 is sufficiently high to turn on transistor 608, allowing current flow through NMOS transistor 608. PMOS transistors 606, 602, and resistor 604 operate as a feedback mechanism to control the CTAT current ($I_{CTAT}$) to complement the PTAT current ($I_{PTAT}$) to generate the reference current ($I_{REF}$), which is sourced on resistor 610 to generate the reference voltage ($V_{REF}$). Thus, the reference current (IREF) is the sum of the PTAT current and the CTAT current according to the following equation:

$$I_{REF}=I_{PTAT}+I_{CTAT} \tag{22}$$

In a particular example, the voltage at the gate of PMOS transistor 606 is approximately one drain-to-source voltage drop for NMOS transistor 608 above ground. The voltage level at the gate of PMOS transistor 606 is approximately one threshold voltage drop below the voltage at the gate of PMOS transistor 602, which is approximately one threshold voltage drop below the voltage on $V_{DD}$. Thus, the minimum supply voltage necessary to generate the CTAT current can be determined according to the following equation:

$$V_{DDMIN}=V_{DS608}+V_{SG606}+VS_{G602} \tag{23}$$

It is possible to provide a CTAT reference circuit that can operate above even lower minimum voltage levels. An example of such a circuit is depicted in FIG. 7.

Figure 7:
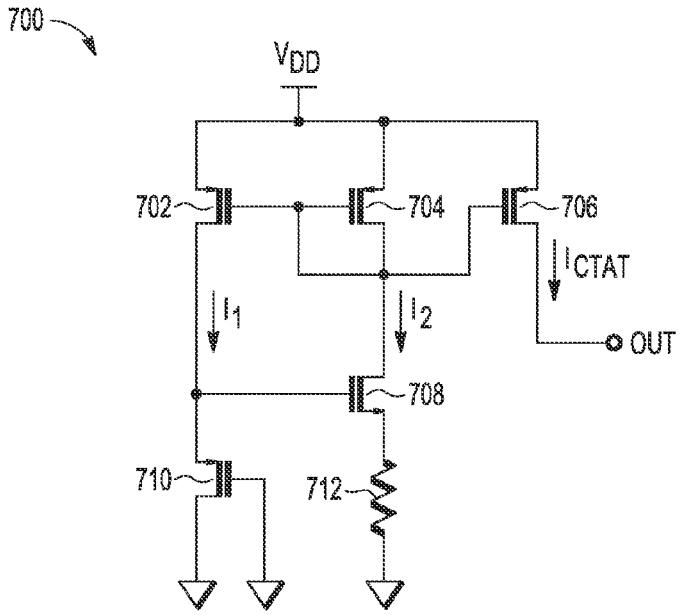
FIG. 7 is a schematic diagram of a third embodiment of a reference circuit to generate a CTAT current.

FIG. 7 is a schematic diagram of a third embodiment of a reference circuit 700 to generate a CTAT current. Circuit 700 includes PMOS transistors 702, 704 and 706. Circuit 700 also includes PMOS transistor 710, NMOS transistor 708 and resistor 712.

PMOS transistor 704 includes a source connected to $V_{DD}$, a gate connected to the gate of PMOS transistor 702, and a drain connected to the gates of PMOS transistors 702, 704, and 706. NMOS transistor 708 includes a drain connected to the drain of PMOS transistor 704, a gate connected to the drain of PMOS transistor 702, and a source connected to the first terminal of resistor 712, which has a second terminal connected to ground. PMOS transistor 710 includes a source connected to the gate of NMOS transistor 708, a gate connected to ground, and a drain connected to ground.

When power is applied to $V_{DD}$, the gates of transistors 702, 704, and 710 are sufficiently negatively biased relative to the voltage on $V_{DD}$ to allow current flow through their respective source-to-drain current paths. If transistors 702, 704, and 706 have approximately the same size, then the respective currents ($I_1$, $I_2$, and $I_{CTAT}$) are approximately equal. Further, the voltage at the source of transistor 710 is approximately one gate-to-source voltage drop above ground, and the minimum voltage to operate circuit 700 reliably is approximately a gate-to-source plus a source-to-drain voltage drops (i.e., $V_{SG}$ of transistor 710 and $V_{SD}$ of transistor 702) above ground. Thus, circuit 700 decreases the minimum voltage needed for proper functionality, as compared to the circuit of FIG. 5.

Figure 8:
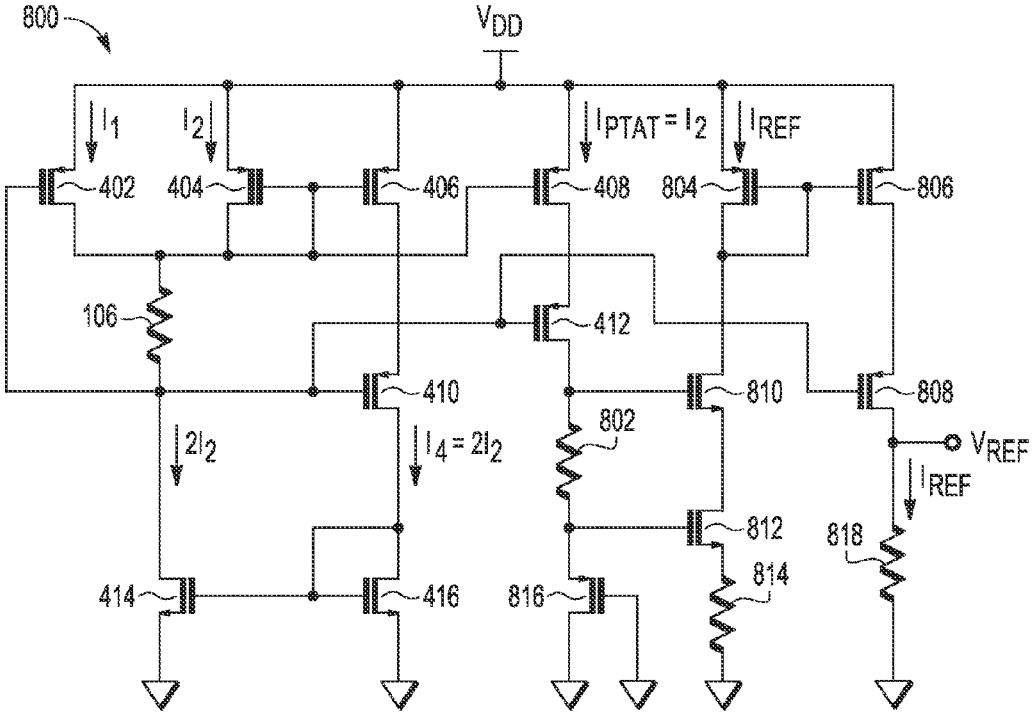
FIG. 8 is a schematic diagram of an embodiment of a drain-coupled PMOS reference circuit to generate a reference current with low-voltage thermal compensation that employs the third embodiment of a CTAT current reference.

FIG. 8 is a schematic diagram of an embodiment of a drain-coupled PMOS reference circuit 800 to generate a reference current ($I_{REF}$) with low-voltage thermal compensation. Circuit 800 includes circuit 400 of FIG. 4 (without resistor 118) cascaded with the CTAT reference circuit 700 of FIG. 7. However, since the CTAT reference circuit is configured differently in circuit 800, the elements of the CTAT reference circuit are renumbered. The CTAT reference circuit portion includes PMOS transistors 804, 806, 808, and 816, resistors 802, 814, and 818, and NMOS transistors 810 and 812.

PMOS transistor 804 includes a source connected to the first power supply terminal ($V_{DD}$), a gate, and a drain connected to its gate. PMOS transistor 806 includes a source connected to $V_{DD}$, a gate connected to the gate of PMOS transistor 804, and a drain. PMOS transistor 808 includes a source connected to the drain of PMOS transistor 806, a gate connected to the gate of PMOS transistor 412, and a drain connected to a first terminal of resistor 818. Resistor 818 includes a second terminal connected to ground.

NMOS transistor 810 includes a drain connected to the drain of PMOS transistor 804, a gate connected to the drain of PMOS transistor 412, and a source. Resistor 802 includes a first terminal connected to the drain of PMOS transistor 412 and a second terminal. PMOS transistor 816 includes a source connected to the second terminal of resistor 802, a gate connected to ground, and a drain connected to ground.

NMOS transistor 812 includes a drain connected to the source of NMOS transistor 810, a gate connected to the second terminal of resistor 802, and a source connected to a first terminal of resistor 814. Resistor 814 includes a second terminal connected to ground.

In the illustrated embodiment, PMOS transistors 406 and 410 are sized to provide a two-to-one (2:1) ratio relative to each of the transistors 402 and 404. PMOS transistor 408 is configured to mirror the current ($I_2$) to produce the PTAT current ($I_{PTAT}$). The $I_{PTAT}$ current flows through PMOS transistors 408 and 412 and is sourced on resistor 802, biasing transistors 816, 812 and 810. Thus, the reference current ($I_{REF}$) flows through across resistor 814 and through transistors 812, 810 and 804. Further, the voltage at the gate of PMOS transistor 412 is applied to the gate of PMOS transistor 808. The reference current ($I_{REF}$) is mirrored by transistor 806 to generate an output reference current ($I_{REF}$) that includes both CTAT and PTAT components. Reference current is sourced on resistor 818 to generate the reference voltage ($V_{REF}$).

Thus, circuit 800 is configured to provide thermal compensation. In particular, the $I_{PTAT}$ current through transistor 408 is proportional to absolute temperature. The $I_{PTAT}$ current biases the diode-connected PMOS transistor 816, which has a CTAT voltage drop across the device, providing a thermal compensation mechanism.

The thermal compensation can be produced by cascading a drain-coupled NMOS reference circuit, such as the reference circuits 100, 200, and 300 depicted in FIGS. 1-3, with the CTAT reference circuit depicted in FIG. 7. An example of such a circuit is depicted in FIG. 9.

Figure 9:
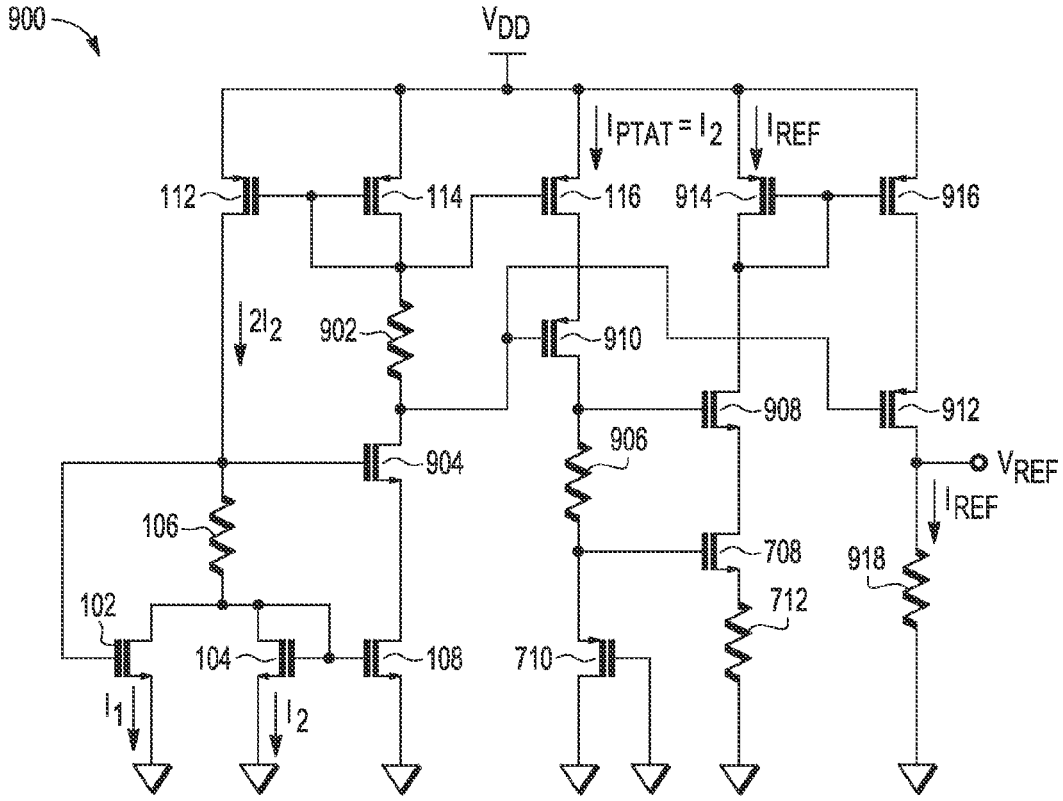
FIG. 9 is a schematic diagram of an embodiment of a drain-coupled NMOS reference with low-voltage thermal compensation.

FIG. 9 is a schematic diagram of an embodiment of a drain-coupled NMOS reference circuit 900 with low-voltage thermal compensation. Circuit 900 includes circuit 200, depicted in FIG. 2, combining transistors 110 and 112 in a single devices, and modified to include PMOS cascoding transistors 910 (former 412), 912 (former 606), and NMOS cascoding transistors 904 and 908, as well as resistors 902 and 906. Circuit 900 further includes transistors 708 and 710 and resistor 712 from FIG. 7, as well as the current mirror 914 and 916 which provides the reference current ($I_{REF}$) at the output. The current ($I_{REF}$) is sourced on the resistor 918 to generate the reference voltage ($V_{REF}$)

PMOS transistors 112 and 114, resistor 106, and NMOS transistors 102, 104, and 108 are configured as described with respect to FIG. 2. PMOS transistors 116, 910, 914, and 912, and resistor 918 are configured as described with respect to FIG. 6, except the gate of PMOS transistor 116 and the gate and drains of PMOS transistor 910 are connected differently. In particular, the gate of transistor 116 is connected to the drain of transistor 114, and the gate of transistor 910 is connected to a second terminal of resistor 902. Further, the drain of PMOS transistor 910 is connected to a gate of NMOS transistor 908 and to a first terminal of resistor 906.

Resistor 902 includes a first terminal connected to the drain of PMOS transistor 114 and to the gates of PMOS transistors 112 and 116. Resistor 902 includes the second terminal, which is connected to the gates of PMOS transistors 910 and 912 and to a drain of NMOS transistor 904. Transistor 904 further includes a gate connected to the drain of PMOS transistor 112 and a source connected to the drain of NMOS transistor 108.

Resistor 906 includes the first terminal connected to the drain of transistor 910 and includes a second terminal connected to a gate of NMOS transistor 708 and to a source of PMOS transistor 710. PMOS transistor 710 includes a gate and a drain, which are connected to ground.

NMOS transistor 908 includes a drain connected to the drain of PMOS transistor 914, a gate connected to the drain of PMOS transistor 910, and a source connected to the drain of NMOS transistor 708. NMOS transistor 708 includes a source connected to a first terminal of resistor 712, which has a second terminal connected to ground.

In the illustrated embodiment, the drain-coupled current reference circuit 900 generates a constant current based on the gate-to-source voltage difference of transistors 102 and 104. The first current ($I_1$) and the second current ($I_2$) flow through transistors 102 and 104, respectively. The difference in gate-to-source voltages is applied across resistor 106 to set the sum current ($I_1+I_2$), while the current through transistor 108 is double the current through transistor 104.

In the illustrated embodiment, transistor 916 mirrors the reference current ($I_{REF}$) generated across resistor 712, and sources the reference current ($I_{REF}$) through transistor 912 on resistor 918 to generate the reference voltage ($V_{REF}$). The PTAT current ($I_{PTAT}$) is sourced through resistor 906 to bias transistors 710, 708 and 908. The gate-to-source voltage difference between transistors 710 and 708, across resistor 712, generates a thermally compensated reference current.

The circuits described above with respective to FIGS. 1-9 can be used to produce a reference current. In each of the circuits, the reference current can be controlled by controlling the relative sizing and parameters of the various circuit components, such as resistance values and width-to-length ratios of transistors. Further, the reference current can be configured by controlling the gate oxide thicknesses of transistors 102 and 104 or 402 and 404, depending on whether the reference is generated based on gate-to-source voltage differences between the NMOS transistors (FIGS. 1-3 and 9) or between the PMOS transistors (FIGS. 4-8).

Since the gate-to-source voltages are related to the threshold voltages, the relatively constant current can thus be maintained based on the threshold voltage differences between the transistors. Accordingly, the gate oxide thicknesses can also be adjusted to control the threshold voltages. Transistors with different oxide thickness are common in most CMOS technologies with gate lengths smaller than 0.5 um. Such CMOS technologies can provide thin oxide devices and thick oxide devices, in order to support various gate bias voltages, such as, for example, 2.5V and 5V.

For example, assuming that the oxide thickness ($X_{OX}$) of transistor 102 is greater than the oxide thickness of transistor 104 (i.e., $X_{OX102}>X_{OX104}$) while the other voltage threshold ($V_{Th}$) related parameters are substantially the same, as well as the width, length and electric charge carriers mobility, transistor 102 exhibits a higher threshold voltage than that of transistor 104 (i.e., $V_{Th102}>V_{Th104}$). The oxide thickness of transistors 102 and 104 determines the amount of current flowing through resistor 106, according to the relationship between the gate-to-source voltages:

$$V_{GS102}=V_{GS104}+2I_2R_{106} \tag{24}$$

The reference current can thus be determined based on a difference between the threshold voltages of transistors 102 and 104 divided by the resistance of resistor 106. Similarly, the oxide thicknesses of PMOS transistors 402 and 404 can also be adjusted to control the threshold voltages.

Further, when resistors 106 and 610 are of the same type, variation of the reference current ($I_{REF}$) with temperature due to the thermal coefficient of resistor 106 is not reflected in the output reference voltage ($V_{REF}$). Moreover, certain technologies implement resistors with very low temperature coefficients, which reduces the contribution of resistor 106 to the temperature variations of the reference current ($I_{REF}$). When the oxides of transistors 102 and 104 have substantially equal thermal coefficients, then the variation due to the temperature of the transistors 102 and 104 is approximately zero.

As for the contribution of the substrate effect to the thermal variation of the threshold voltage, for lightly and moderate substrate doping densities (up to $10^{15}$ $cm^{-3}$) and in the absence of substrate bias, variation due to the substrate effect is in the range of a microvolt per degree Kelvin (μV/° K), and thus is considered a second order thermal effect. Thus, circuit 900 achieves a first order thermal compensation.

In another embodiment, the reference voltage ($V_{REF}$) can be produced based on the threshold implant difference. Such implant differences produce threshold voltage differences between transistors 102 and 104. When the enhancement implant ($Q_e$) for threshold voltage control is a shallow implant located at the oxide-semiconductor interface, which does not have a significant contribution to the surface inversion potential ($\Phi_S$), and which does not change the mobility of the carriers ($\mu_n$), the reference current ($I_{REF}$) is a function of the enhancement implantation, the resistance of resistor 106, and the oxide capacitance ($C_{OX}$) according to the following equation:

$$I_{REF} = \frac{Q_i}{R_{106}C_{OX}} \tag{26}$$

If $Q_i$ and $C_{OX}$ are substantially constant with temperatures of the first order, variation of the reference current ($I_{REF}$) is due to resistor 106.

In an alternative embodiment, the resistance between the drain electrode and the gate electrode of transistor 102 can be varied digitally. An example of such a circuit with a digitally programmable resistance is depicted in FIG. 13.

Figure 13:
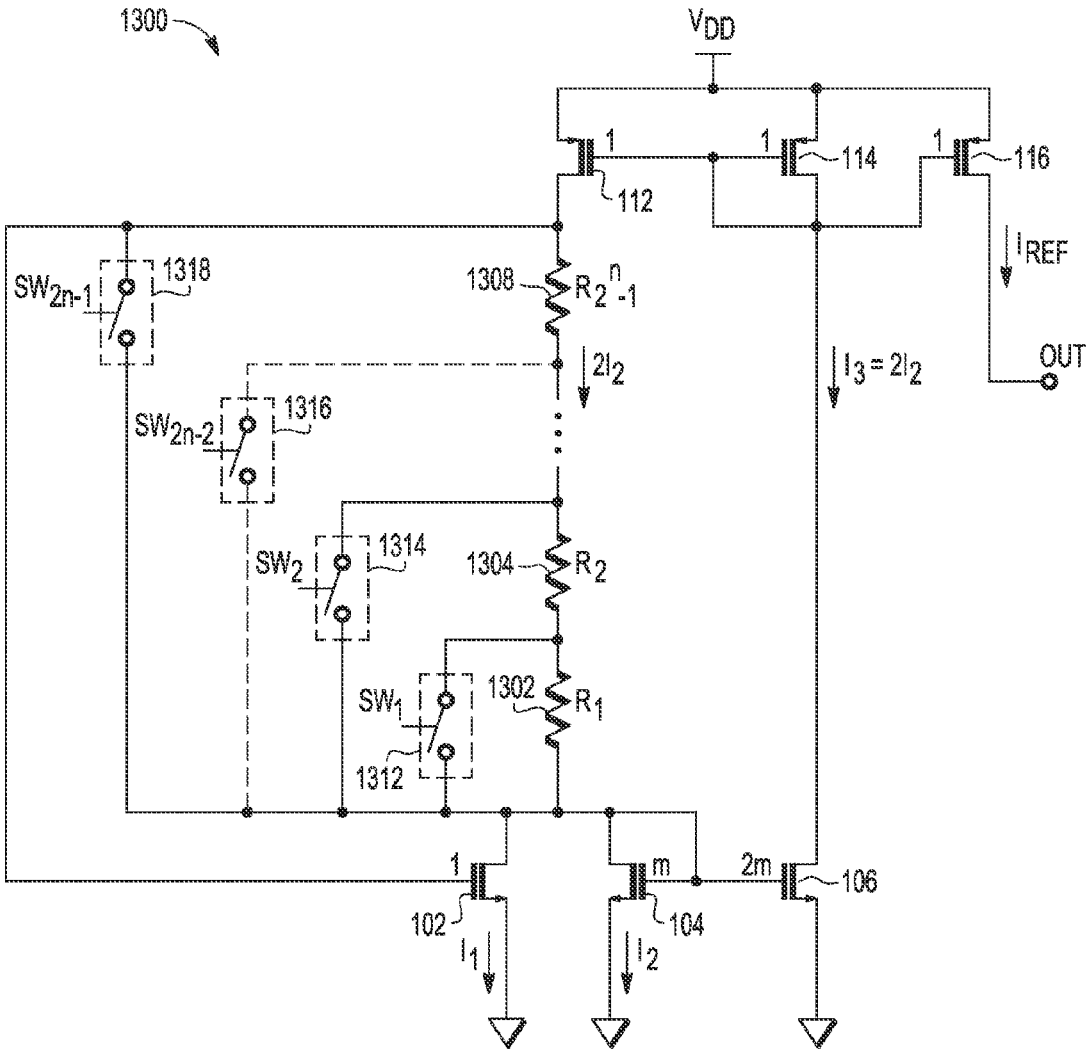
FIG. 13 is a schematic diagram of an alternative embodiment of a drain-coupled current reference including multiple switches for adjusting a resistance between gate and drain terminals of the first MOS transistor.

FIG. 13 is a schematic diagram of an alternative embodiment of a drain-coupled current reference circuit 1300 including multiple switches 1312, 1314, 1316, and 1318 for adjusting a resistance between the gate electrode and the drain electrode of transistor 102. As compared to the bias stage of circuit 900 in FIG. 9, transistor 904 and resistor 902 are omitted, and resistors 1302, 1304, and 1308 are added in series between the drain electrode of transistor 112 and the drain electrode of transistor 102. A potentiometer or other control circuit (not shown) is coupled to each of the switches 1312, 1314, 1316, and 1318 to selectively alter a resistance between the drain and gate electrodes of transistor 102.

In operation, switches 1310, 1312, 1314, 1316, and 1318 allow a digital sequence from the potentiometer or other control circuit to control the value of the reference current, depending on the number of elemental resistors connected between the common drain and the gate of the transistor 102. The digital sequence alters the number of elemental resistors separating the drain and the gate of transistor 102, thereby altering the gate voltage of transistor 102 and the reference current ($I_{REF}$).

In another alternative embodiment, transistors 102, 104 and 108 can be replaced with programmable floating-gate transistors. In such an instance, the gate-to-source voltage difference between transistors 102 and 104 can be produced by programming the charge stored on the floating gates. The floating gate transistors 1002, 1004, and 1008 depicted in FIG. 10 (corresponding to transistors 102, 104, and 108 in FIG. 9) can be configured by conventional programming and erasing techniques. However, a circuit that is particularly useful in more precisely placing desired amounts of charge on the floating gates is described in FIG. 10, as one example out of many possible examples of such programming circuitry.

Figure 10:
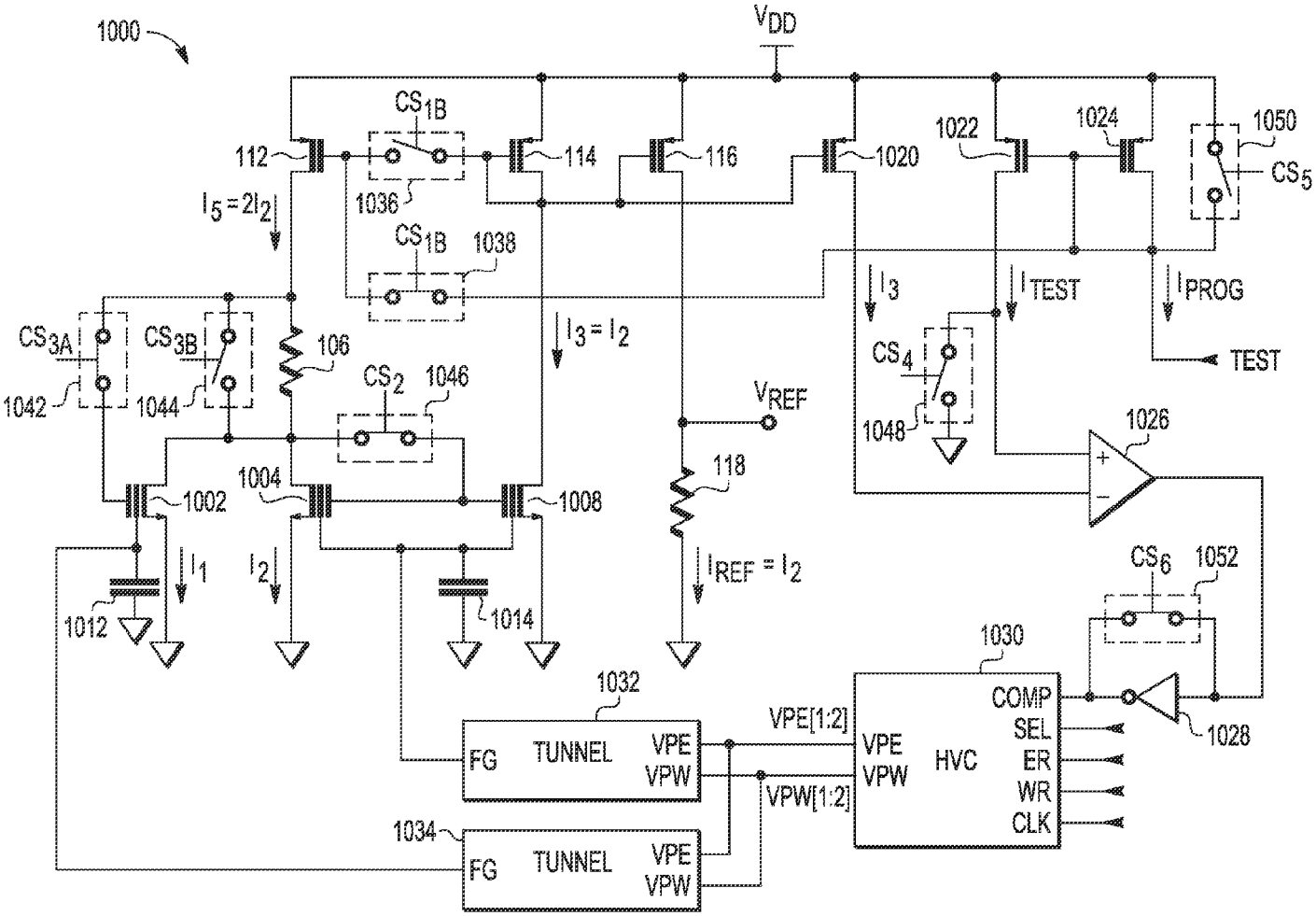
FIG. 10 is a partial block and partial schematic diagram of a circuit including an embodiment of a reference circuit having floating-gate transistors and including programming circuitry.

FIG. 10 is a partial block and partial schematic diagram of an embodiment of a circuit 1000 including an embodiment of a reference circuit having floating-gate transistors and including programming circuitry. Circuit 1000 includes PMOS transistors 112, 114, 116, 1020, 1022, and 1024, resistors 106 and 118, and floating-gate transistors 1002, 1004, and 1008. Transistors 112, 114, and 116, and resistors 106 and 118 are configured as shown and described above with respect to FIG. 1-3, except that NMOS transistors 102, 104, and 108 are replaced with programmable floating-gate transistors. In this embodiment, transistors 112 and 114 are configured to provide a 2:1 current mirroring ratio, such that the current flowing through transistor 112 is twice the current flowing through transistor 114.

Further, in the illustrated embodiment, switches 1036, 1038, 1042, 1044, and 1046 are included to provide means for selectively disconnecting the various interconnections during write and erase operations. In particular, switch 1036 includes a first terminal connected to the gate of PMOS transistor 112 and a second terminal connected to the gate of PMOS transistor 114. Switch 1038 includes a first terminal connected to the gate of PMOS transistor 112 and a second terminal connected to gates of PMOS transistors 1022 and 1024. Switch 1042 includes a first terminal connected to the first terminal of resistor 106 and a second terminal connected to the gate of floating-gate transistor 1002. Switch 1044 includes a first terminal connected to the first terminal of resistor 106 and a second terminal connected to the drains of floating-gate transistors 1002 and 1004. Switch 1046 includes a first terminal connected to the drain of floating-gate transistor 1004 and a second terminal connected to the gates of floating-gate transistors 1004 and 1008.

Circuit 1000 also includes a programming loop including PMOS transistors 1020, 1022, 1024, comparator 1026, high voltage controller 1030, and tunnel circuitry 1032 and 1034 for programming the floating gates of floating-gate transistors 1002, 1004, and 1008. PMOS transistor 1020 includes a source connected to $V_{DD}$, a gate connected to the gate of PMOS transistor 116, and a drain connected to a negative input of comparator 1026. PMOS transistor 1022 includes a source connected to $V_{DD}$, a gate connected to the second terminal of switch 1038, and a drain connected to a positive input of comparator 1026 and to a first terminal of switch 1048. Switch 1048 includes a second terminal connected to ground. PMOS transistor 1024 includes a source connected to $V_{DD}$, a gate connected to the gate of PMOS transistor 1022, and a drain connected to its gate and to a test pin (TEST). Additionally, the drain of PMOS transistor 1024 is connected to a first terminal of switch 1050, which has a second terminal connected to $V_{DD}$. In an embodiment, the test pin (TEST) may be accessible to apply a test signal to the circuit, such that to determine the desired current to be programmed.

Floating-gate transistor 1002 includes a drain connected to the second terminal of resistor 106 and to a second terminal of switch 1044, a gate connected to a second terminal of switch 1042, and a source connected to ground. Additionally, floating-gate transistor 1002 includes a programmable floating gate, which is represented by capacitor 1012.

Floating-gate transistor 1004 includes a drain connected to the second terminal of resistor 106, to a first terminal of switch 1046, to a second terminal of switch 1044, and to the drain of floating-gate transistor 1002. Floating-gate transistor 1004 also includes a gate connected to a second terminal of switch 1046 and includes a source connected to ground. Floating-gate transistor 1008 includes a drain connected to the drain of PMOS transistor 114, a gate connected to the gate of floating-gate transistor 1004, and a source connected to ground. Additionally, floating-gate transistors 1004 and 1008 include programmable floating gates, which are represented by capacitor 1014.

Comparator 1026 includes an output connected to a first terminal of inverter 1028 and to a first terminal of switch 1052. Inverter 1028 has a second terminal and switch 1052 has a second terminal, which are both connected to a control input (COMP) of high voltage controller 1030. High voltage controller 1030 further includes a select input (SEL), an erase input (ER), a write input (WR), and a clock input (CLK). High voltage controller 1030 is responsive to the various inputs to configure the floating-gates of transistors 1002, 1004, and 1008 through tunnel circuitry 1034 and 1032, respectively. A select signal at the SEL input selects which of the transistors 1002 or 1004 and 1008 to be programmed. Switch 1052 selects the polarity of the current comparison result within the programming algorithm, as a function of the devices to be programmed, either 1002 or 1004 and 1008. An erase signal or a write signal received at the ER and WR inputs of high voltage controller 1030 determines which high-voltage programming cycle the circuit 1000 is undergoing. A clock signal received at the CLK input of high voltage controller 1030 drives a high-voltage generator, which is implemented with a charge-pump circuit. These signals also enable the charge-pump clock drivers, which receive the external clock signal (CLK) and provide non-overlapping phases of charge-pump drive signals.

Based on the configuration of its inputs, high voltage controller 1030 is adapted to selectively program the floating gates of transistors 1002, 1004, and 1008 by applying signals to one or both of the tunnel circuits 1032 and 1034. In circuit 1000, the tunneling circuitry 1032 and 1034 are MOS diodes that share their polysilicon gates with the floating-gates of MOS transistors 1002, 1004, and 1008.

High voltage controller 1030 and tunnel circuit 1032 cooperate to program the floating gates of transistors 1004 and 1008, thus changing the electric charge on the floating gate, as represented by capacitor 1014, and modifying the gate-to-source voltage of transistors 1004 and 1008 to achieve precise values for both $I_{REF}$ and $V_{REF}$. Similarly, tunnel circuit 1034 and high voltage controller 1030 cooperate to program the floating gate of transistor 1002, thus changing the electric charge on the floating gate, as represented by capacitor 1012, and modifying the gate-to-source voltage of transistor 1002.

A native threshold voltage, which can be considered of similar value for the floating-gate transistors 1002, 1004, and 1008, characterizes the original state of the floating-gate transistors 1002, 1004, and 1008 before performing any programming. In such a native state, due to identical sizes of the floating-gate transistors 1002, 1004, and 1008, the circuit 1000 in read configuration has zero current. However, when the floating-gate transistors 1004 and 1008 are programmed to a lower threshold voltage than the threshold voltage of transistor 1002, a non-zero current through resistor 106 is maintained by the feedback loop provided by transistors 1004, 1114, and 112 and by the control element transistor 1002.

In a read configuration, the switch 1036 is on, switch 1038 is off, switches 1042 and 1046 are on and 1044 is off. The test current branches are disabled through the switch 1050 which is on, while the positive input of comparator 1026 is grounded through the switch 1048 which is on, in order to avoid floating this node.

In a test mode, before any programming is performed, switch 1036 is open while 1038 is closed, and an external test current ($I_{PROG}=I_{TEST}$) is mirrored by transistor 112 with a multiplication factor of two, biasing the pair of transistor 1002 and 1004 through resistor 106. When the transistors 1002, 1004, and 1008 are in their native states, the gate-to-source voltage of transistor 1002 is greater than the gate-to-source voltage of transistor 1004, so that the first current ($I_1$) is greater than the second current ($I_2$), and the current ($I_3$) through transistor 1008 matches the second current ($I_2$). The test current ($I_{TEST}$) is greater than the current ($I_3$).

Comparator 1026 compares the current ($I_3$) with the test current ($I_{TEST}$) and provides a feedback signal to the COMP input of high-voltage controller 1030, which controls the tunneling devices 1032 and 1034. As long as the test current ($I_{TEST}$) is greater than the current ($I_3$), the high-voltage generator inside high voltage controller 1030 is enabled. The high-voltage generator is implemented with a charge-pump circuit, driven by the clock signal (CLK). The signals ER and WR define the programming operation that will be executed, either erase or write.

When the transistors 1002, 1004, and 1008 are in their native states, a WRITE procedure can be initiated in test-mode, which extracts negative electric charge from the floating gates, thus lowering the control gate equivalent threshold voltage of transistors 1004 and 1008, decreasing gate-to-source voltages ($V_{GS1004}$) and ($V_{GS1008}$) of transistors 1004 and 1008. The procedure continues until the current ($I_3$) reaches the same level as the test current ($I_{TEST}$). When the current ($I_3$) matches the test current ($I_{TEST}$), comparator 1026 disables the high-voltage cycle. Switches 1036, 1048 and 1050 are restored to the on-state, while switch 1038 is restored to the OFF-state. At this point, the reference current ($I_{REF}$) equals the second current ($I_2$) and the current ($I_3$), which have the same value as the programmed current ($I_{PROG}$).

Usually, programming involves two high-voltage cycles. The first high voltage cycle erases floating-gate devices 1004 and 1008, bringing them into a default state that allows further trimming to a final state of high-precision adjustment. The second high-voltage cycle, regarded as the write cycle, performs the fine-tuning of floating-gate transistors 1004 and 1008, until the target reference current ($I_{REF}$) condition is achieved with a desired level of precision. Considering a trimming procedure that involves erase/write programming of the floating-gates of transistors 1004 and 1008, transistor 1002 has the function of a reference transistor, biased by the external current ($I_{PROG}$) mirrored through transistor 112. The erase process of the transistors 1004 and 1008 raises their equivalent threshold voltages above the native threshold level without the control of the comparator loop, such as differential amplifier 1026 and associated circuitry. Thus, during erase, switch 1036 is on, switch 1038 is off, switches 1046 and 1044 are off, while switches 1048 and 1050 are on and switch 1052 can be either on or off, since the erase high-voltage cycle is not controlled by the test-mode loop, but rather by the user-defined duration of the erase signal applied to the ER input of high voltage circuit 1030. At the end of the ERASE operation, the transistors 1004 and 1008 have high thresholds, and no current flows through the circuit 1000.

The write operation of the devices 1004 and 1008 following the erase operation is performed in two steps. The first step is intended to lower the threshold of transistors 1004 and 1008 down to the native value of transistor 1002. In this regard, switch 1036 is off, switch 1038 is on, switches 1042, 1044 and 1046 are on, switch 1052 is on, switches 1048 and 1050 are off, and the external programming current ($I_{PROG}$) is used to enable the control loop. The write signal applied to the WR input of high voltage controller 1030 is enabled until the current ($I_3$) equals the test current ($I_{TEST}$), when the threshold voltages of transistors 1004 and 1008 are approximately equal to the native threshold of transistor 1002.

The second step includes turning off switch 1044 and applying the high-voltage write signal to the tunneling structure 1032 until the current ($I_3$) equals the test current ($I_{TEST}$). At this point, the programming of circuit 1000 is completed and the high-voltage generator of high voltage controller 1030 is automatically turned-off. Circuit 1000 returns to its read configuration, with switch 1036 on, switch 1038 off, switches 1042 and 1046 on, switch 1044 off, and switches 1048, 1050 and 1052 on.

To program the floating gate of transistor 1002, the erase operation is performed without a control loop and the duration of the high-voltage cycle is defined by the user. During the erase operation, switch 1036 is on, switch 1038 is off, switches 1042, 1044 and 1046 are off, switches 1048 and 1050 are on, while switch 1052 can be either off or on. At the end of the erase operation, the equivalent threshold on the control gate of transistor 1002 is high, and transistor 1002 is turned off.

The write operation following the erase operation is controlled by the programming loop, with switch 1036 off, switch 1038 on, switches 1042 and 1046 on, switch 1044 off, switches 1048 and 1050 off, and switch 1052 off. As long as transistor 1002 is not conductive, the programming current ($I_{PROG}$) multiplied by the mirroring factor of transistor 112, is sourced on transistor 1004 through resistor 106, and copied on transistor 1008. During the write operation, the negative electric charge on the floating gate of transistor 1002 is extracted, and the equivalent threshold voltage on the control gate decreases, bringing transistors 1002 into conduction, reducing the current through transistor 1004. When the current ($I_3$) reaches the level of the test current ($I_{TEST}$), the control signal at the output of comparator 1026 disables the high-voltage generator of high voltage controller 1030 and the write operation is concluded.

The programming technique for programming the floating gates of transistors 1002, 1004, and 1008 allows for continuous trimming (continuous adjustment) until the target parameter is achieved, without requiring multiple write pulses such as in program-verify algorithms. In an alternative embodiment, circuit 1000 offers the possibility of reversing the programming sequence by applying first the write cycle, which decreases the threshold voltages of the floating-gate transistors 1002, 1004, and 1008, and then gradually increases the threshold voltages through a controlled erase procedure. Such a sequence however, uses a pulsed high-voltage erase cycle followed by an evaluation stage, within a repeated cycle that stops when the desired reference current ($I_{REF}$) is achieved.

The programming technique disclosed above is a representative example of a way to program the floating-gate transistors 1002, 1004, and 1008 out of many possible ways. Other programming techniques and different ordering of the steps is also possible. For example, in an alternative embodiment, the programming processes described in the previous sections can be successively applied to transistors 1004 and 1008 and then to transistor 1002, while the level of the programmable currents is chosen appropriately for each programming stage. It should be understood that any of the read and/or write algorithms can also be applied individually to program a selective floating-gate transistor without programming the other transistors.

Figure 11:
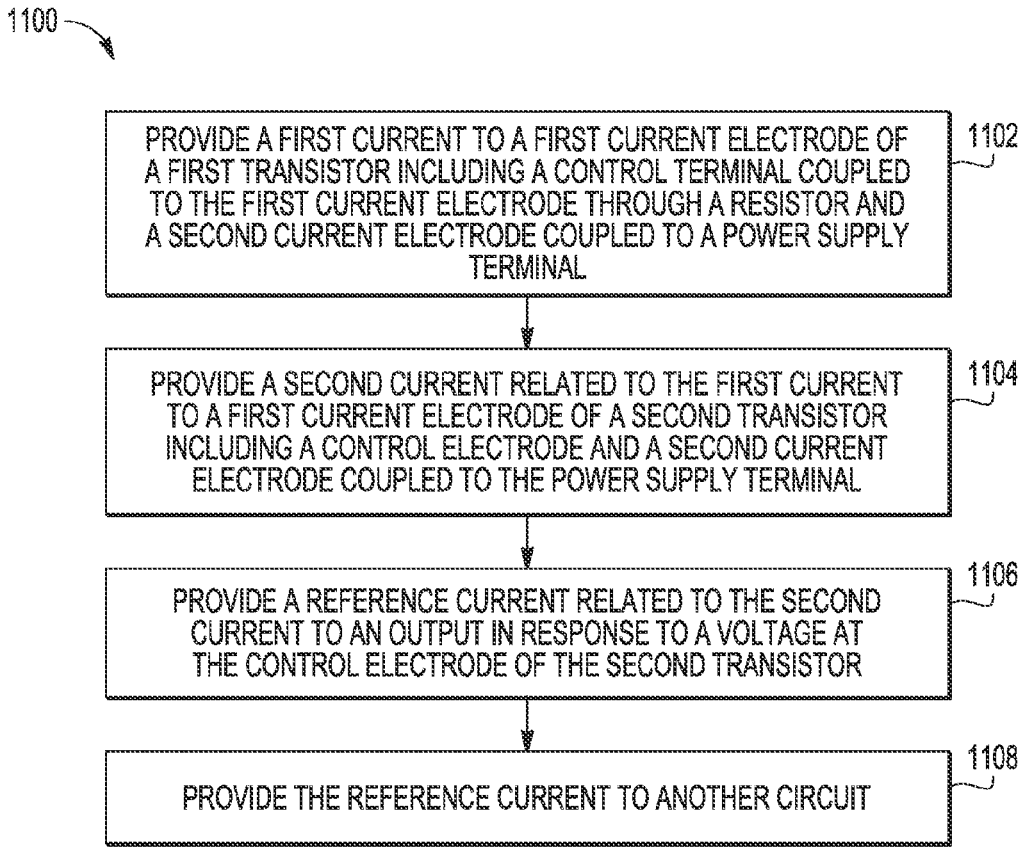
FIG. 11 is a flow diagram of an embodiment of a method of providing a reference current.

FIG. 11 is a flow diagram of an embodiment of a method 1100 of providing a reference current. At 1102, a first current is provided to a first current electrode of a first transistor, which includes a control terminal coupled to the first current electrode through a resistor and a second current electrode coupled to a power supply terminal. In an embodiment, the first current is provided to the first current electrode of the first transistor through a first terminal of a current mirror. Continuing to 1104, a second current related to the first current is provided to a first current electrode of a second transistor, which includes a control electrode and a second current electrode coupled to the power supply terminal. In an embodiment, the second current is provided to the first current electrode of the second transistor through a second terminal of the current mirror.

Proceeding to 1106, a reference current related to the second current is provided to an output in response to a voltage at the control electrode of the second transistor. In an example, the reference current is provided by generating an output signal based on the second current using a third transistor and mirroring the output signal to produce the reference current using a current mirror coupled to the third transistor. Proceeding to 1108, the reference current is provided to another circuit.

In a particular example, the first and second transistors are floating-gate transistors. In such an example, the method further includes selectively programming a threshold voltage of at least one of the first and second transistors using a programming circuit.

In another particular example represented in FIG. 13, the resistance between the control electrode and the first current electrode of the first transistor 102 can be reconfigured for adjusting the reference current. For example, switches 1312,

1314, 1316, and 1318 are selectable to bypass one or more of the resistors 1302, 1304, and 1308. At any given time, only one of the switches is activated to select the resistance between the control and first current electrodes of transistor 102. In such an example, the method further includes selectively programming a digital sequence which controls the electronic switches that reconfigure the resistor. Furthermore, the method includes on-chip non-volatile programmability of the digital control sequence.

Figure 14:
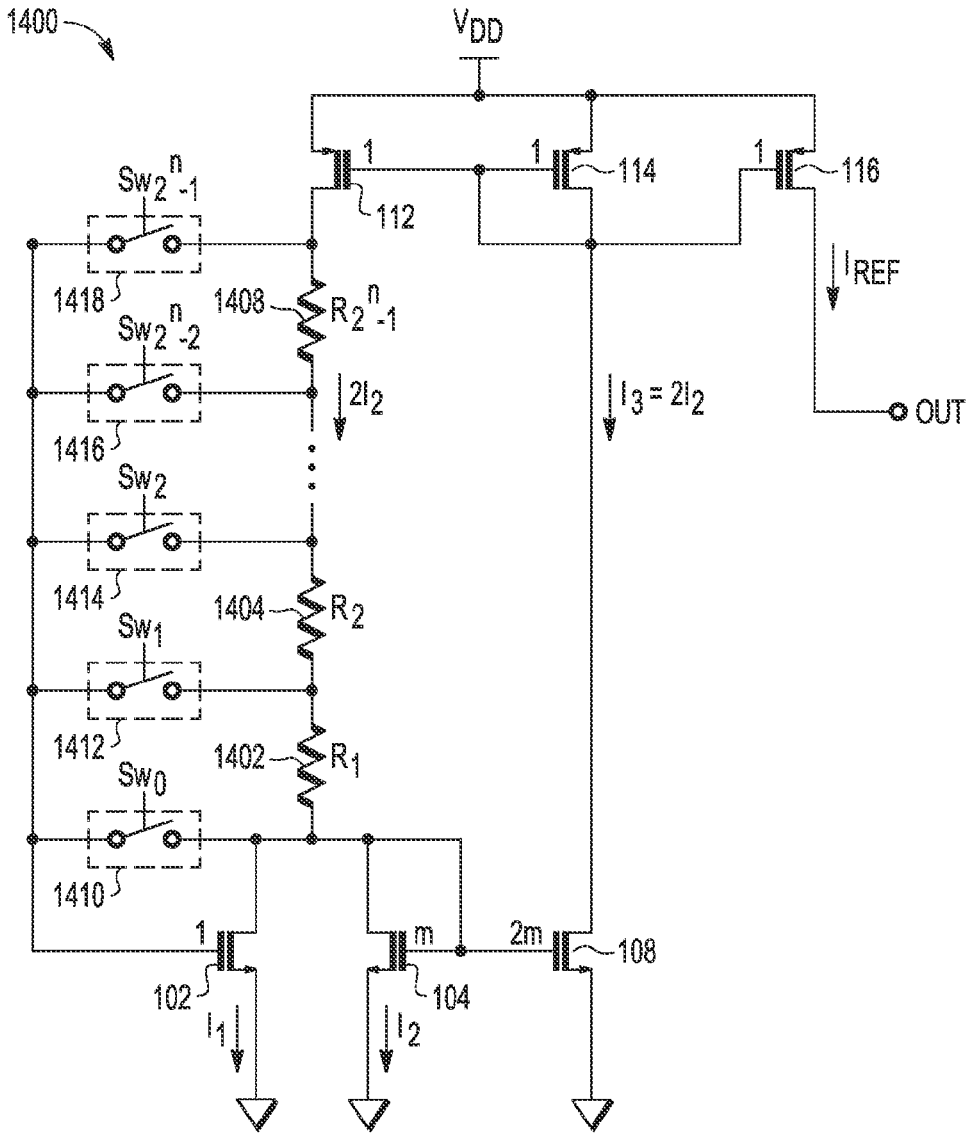
FIG. 14 is a schematic diagram of an alternative embodiment of a drain-coupled current reference with adjustable resistance between the gate and drain terminals of the first MOS transistor.

In yet another example illustrated in FIG. 14, the amount of resistance between the control electrode and the first current electrode of the first transistor 102 can be reconfigured by selectively connecting the control electrode of the first transistor to various nodes of a configurable resistive network through electronic switches 1412, 1414, 1416, and 1418, which are controlled by digital signals. Furthermore, the method includes on-chip non-volatile programmability of the digital sequence that controls the electronic switches. When the reference is operated in subthreshold, VREF can be collected from the drain of transistor 112 and this embodiment can be used for the digital control of the temperature coefficient of VREF, based on a similar thermal compensation principle to that expressed by formula (17) and (19) and illustrated in FIG. 12.

In the embodiments 1300 and 1400 depicted in FIGS. 13 and 14, the switches are controlled by logic signals or non-volatile programmable digital signals. Further, while the switches and resistors are shown to cooperate to form a resistive network that is configurable to alter the resistance, it should be understood that, in other embodiments, the resistive element may be provided using a switched impedance network or switched programmable floating-gate transistors.

In conjunction with the circuits and methods described above with respect to FIGS. 1-14, a reference circuit is disclosed that is configurable to provide a reference current that is thermally stable, even at low voltages. Embodiments of the reference circuit apply the difference of gate-to-source voltages of two MOS transistors across a resistor to produce a reference current. The MOS transistors are configured with their drains connected to provide the same drain-to-source ($V_{DS}$) condition for both devices. One of the MOS transistors is configured as a diode (i.e., the gate is connected to one of the current electrodes in a diode configuration) acting as a clamp, and the second MOS transistor operates as a gain device and has its gate connected to one end of the reference resistor. The other end of the resistor is connected to a common drain node of the MOS transistors. A feedback loop preserves the level of current flowing through the reference resistor. In certain embodiments, additional thermal compensation stages are employed for preserving a constant level of current or voltage across a wide range of temperature conditions.

Although the present invention has been described with reference to preferred embodiments, workers skilled in the art will recognize that changes may be made in form and detail without departing from the scope of the invention.

What is claimed is:

1. A circuit comprising: a first transistor including a first current electrode, a control electrode, and a second current electrode coupled to a power supply terminal; a resistive element including a first terminal directly coupled to the control electrode of the first transistor, and a second terminal directly coupled to the first current electrode of the first transistor; a second transistor including a first current electrode directly coupled to the second terminal of the resistive element, a control electrode directly coupled to the second terminal of the resistive element, and a second current electrode coupled to the power supply terminal, the second transistor configured to produce an output signal related to a voltage at the control electrode of the first transistor; and a third transistor including a first current electrode to carry a current related to the output signal, a control electrode coupled to the control electrode of the second transistor, and a second current electrode coupled to the power supply terminal, wherein the first transistor, the second transistor, and the third transistor comprise floating gate transistors.

2. The circuit of claim 1, further comprising:

a programming circuit including a high voltage controller configured to selectively program a threshold voltage of each of the first transistor, the second transistor, and the third transistor.

3. The circuit of claim 1, wherein a current ratio of the second transistor to the third transistor is a one to two ratio.

4. The circuit of claim 1, further comprising:

a first current mirror comprising a first terminal coupled to the first terminal of the third transistor and a second terminal coupled to the first terminal of the resistive element.

5. The circuit of claim 4, further comprising:

a second resistive element comprising a first terminal coupled to the second terminal of the first current mirror and a second terminal coupled to the first terminal of the resistive element.

6. The circuit of claim 4, wherein the first terminal of the first current mirror carries a first mirror current and the second terminal of the first current mirror carries a second mirror current; and wherein a ratio of the first mirror current to the second mirror current is a one to two ratio.

7. The circuit of claim 4, further comprising:

a second current mirror comprising a first terminal coupled to the first current electrode of the third transistor and configured to generate on a second terminal a reference current related to the current through the third transistor; and a second resistive element comprising a first terminal coupled to the second terminal of the second current mirror to generate a reference voltage and a second terminal coupled to the power supply.

8. The circuit of claim 4, further comprising:

a feedback circuit including a first current electrode coupled to the first terminal of the first current mirror, a control electrode coupled to the first terminal of the resistive element, and a second current electrode coupled to the first current electrode of the third transistor.

9. The circuit of claim 4, further comprising:

a feedback circuit including a first terminal coupled to the second terminal of the first current mirror, a second terminal coupled to the first terminal of the resistive element, a third terminal coupled to the first terminal of the first current mirror, and a fourth terminal coupled to the first current electrode of the third transistor.

10. The circuit of claim 1, further comprising: a fourth transistor including a first current electrode coupled to the second power supply terminal, a control electrode for receiving the bias voltage, and a second current electrode coupled to the first current electrode of the second transistor.

11. The circuit of claim 1, wherein a current ratio of the first transistor to the second transistor comprises a 1:m ratio.

12. The circuit of claim 1, wherein the resistive element comprises a resistive network having a resistance that is configurable by means of electronic switches controlled by logic signals.

13. A circuit comprising: a first transistor of a first conductivity type and including a first current electrode coupled to a power supply terminal, a control electrode coupled to the power supply terminal, and a second current electrode; a second transistor of a second conductivity type opposite the first conductivity type, the second transistor including a first current electrode to carry an output current, a control electrode coupled to the second current electrode of the first transistor, and a second current electrode; a resistive element including a first terminal coupled to the second current electrode of the second transistor and a second terminal directly coupled to the power supply terminal; a current source including an output terminal for providing a first current characterized as being proportional to absolute temperature; a second resistive element including a first terminal coupled to the output terminal of the current source, and a second terminal coupled to the second current electrode of the first transistor; a third transistor having a first current electrode, a control electrode coupled to the first terminal of the second resistive element, and a second current electrode coupled to the first current electrode of the second transistor; and a current mirror having an input terminal coupled to the first current electrode of the third transistor, and an output terminal for providing a reference signal.

14. A method of providing a reference current, the method comprising: providing a first current to a first current electrode of a first transistor, the first transistor including a control terminal coupled to the first current electrode of the first transistor through a resistive element, and a second current electrode coupled to a power supply terminal, wherein the first transistor comprises a floating-gate transistor; providing a second current related to the first current to a first current electrode of a second transistor, the second transistor including a control electrode coupled to the first current electrode of the second transistor, and a second current electrode coupled to the power supply terminal, wherein the second transistor comprises a floating-gate transistor; and providing a reference current related to the second current to an output in response to a voltage at the control electrode of the second transistor, wherein the providing comprises generating an output signal based on the second current using a third transistor, the third transistor comprising a floating-gate transistor.

15. The method of claim 14, wherein providing the reference current further comprises: mirroring the output signal to produce the reference current using a current mirror coupled to the third transistor.

16. The method of claim 14, wherein providing the first current comprises:

providing the first current to the first current electrode of the first transistor through a first output terminal of a current mirror.

17. The method of claim 16, wherein providing the second current comprises:

providing the second current to the first current electrode of the second transistor through a second output terminal of the current mirror.

18. The method of claim 14, further comprising:

selectively programming a threshold voltage of each of the first and second transistors using a programming circuit.

19. The method of claim 14, further comprising:

selectively controlling a plurality of switches to alter a number of elemental resistive elements coupled between the control electrode and the first current electrode of the first transistor.

20. The method of claim 19, wherein selectively controlling the plurality of switches comprises non-volatile programming of a sequence of digital control signals.

* * * * *